US005785095A

United States Patent [19]

Kinbara

[11] Patent Number: 5,785,095

[45] Date of Patent: Jul. 28, 1998

[54] SPROCKET WHEEL AND RAPIER BAND USED IN RAPIER LOOM

[75] Inventor: Masahiko Kinbara, Kariya, Japan

[73] Assignee: Kabushiki Kaisha Toyoda Jidoshokki Seisakusho, Kariya, Japan

[21] Appl. No.: 769,953

[22] Filed: Dec. 19, 1996

[30] Foreign Application Priority Data

Dec. 27, 1995 [JP] Japan ..... 7-341387

[51] Int. Cl.[6] ..... D03D 47/27

[52] U.S. Cl. ..... 139/449; 474/153; 474/204

[58] Field of Search ..... 139/449; 474/204, 474/202, 164, 153

[56] References Cited

U.S. PATENT DOCUMENTS

| | | | |
|---|---|---|---|
| 4,690,177 | 9/1987 | Gehring et al. | 139/449 |
| 5,183,083 | 2/1993 | Debaes | 139/449 |

FOREIGN PATENT DOCUMENTS

| | | | |
|---|---|---|---|
| 896771 | 11/1983 | Belgium . | |
| 0126497 | 11/1984 | European Pat. Off. . | |
| 0699789 | 3/1996 | European Pat. Off. . | |
| 2020765 | 11/1970 | Germany . | |
| 29 02 729 | 2/1980 | Germany | 139/449 |
| 59-216946 | 12/1984 | Japan . | |
| 2 178 763 | 2/1987 | United Kingdom | 139/449 |

*Primary Examiner*—Andy Falik

*Attorney, Agent, or Firm*—Brooks Haidt Haffner & Delahunty

[57] ABSTRACT

A combination of a sprocket wheel and a rapier band employed in a rapier loom is improved for extending the service life of the rapier band. Each of the female holes formed in the rapier band for receiving teeth of the sprocket wheel is formed in a frustum-like shape. The teeth of the sprocket wheel have tooth surfaces each including a non-interference portion located above an expansion/contraction-insusceptible layer of the rapier band and an interference portion located underneath the expansion/contraction-insusceptible layer. The non-interference portions do not contact the tooth surfaces, while the interference portions are brought into contact with the wall surfaces of the hole formed in the rapier band when the band is wrapped around the sprocket wheel. Each non-interference portion has a curved surface generated by an involute curve, while each interference portion presents a curved surface which matches the shape of the corresponding wall surface of the female hole formed in the rapier band in the wrapped state thereof.

21 Claims, 18 Drawing Sheets

FIG. 5
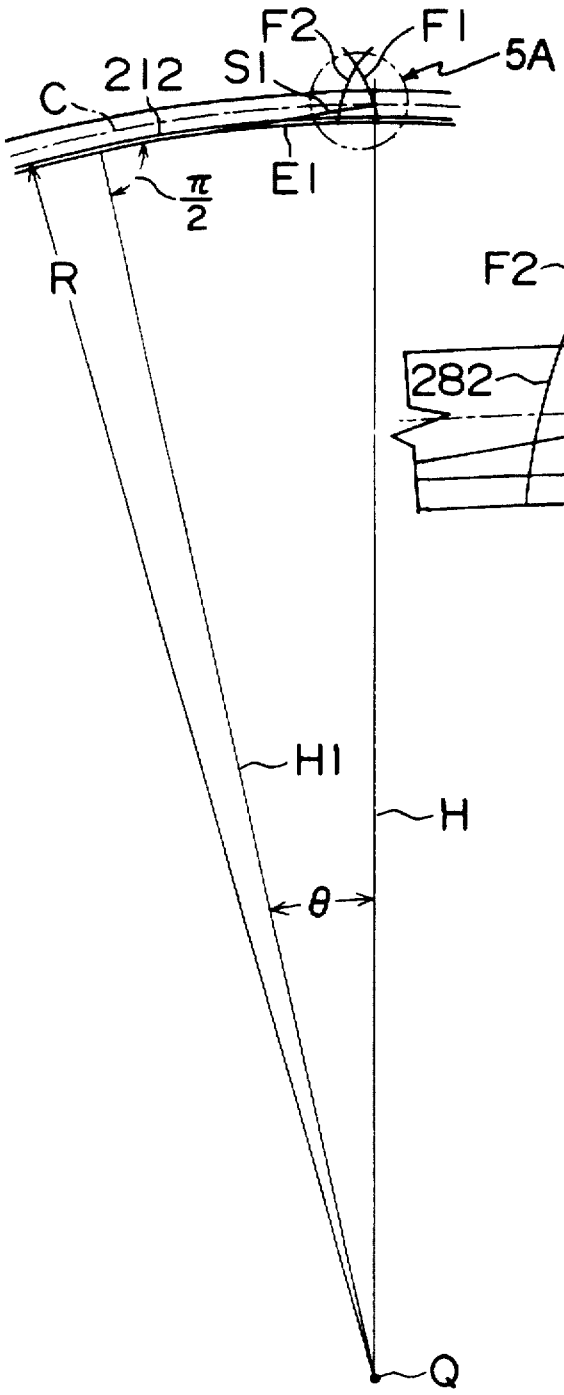
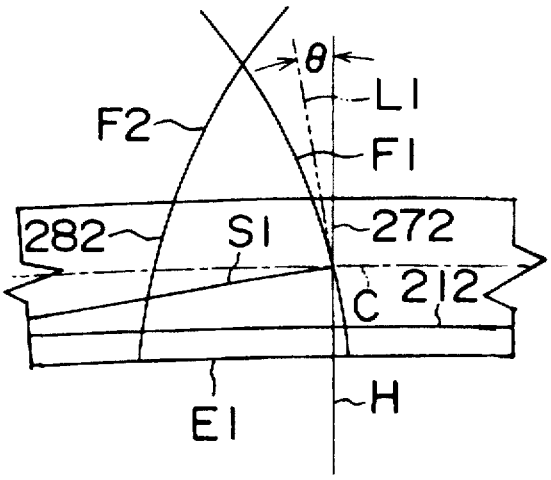
FIG. 5A

FIG. 10
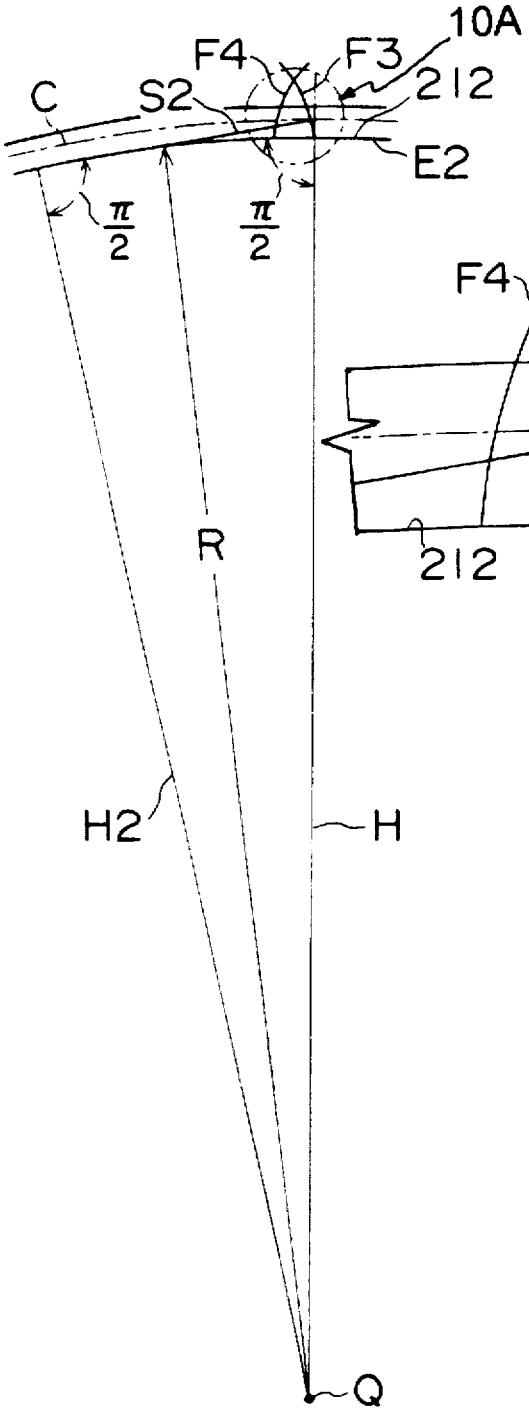
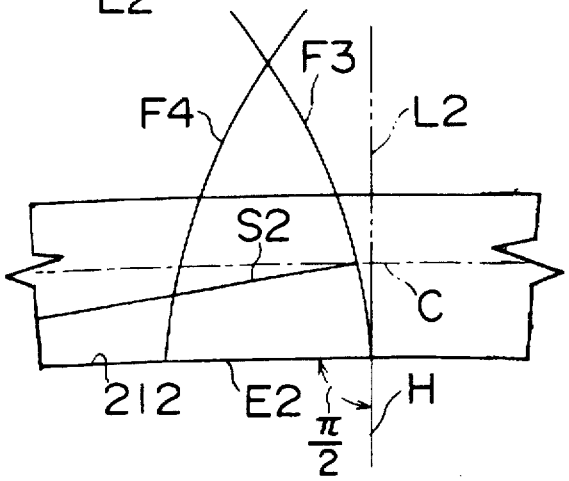
FIG. 10A

SPROCKET WHEEL AND RAPIER BAND USED IN RAPIER LOOM

BACKGROUND OF THE INVENTION

1. Field of the Invention

The present invention generally relates to a sprocket wheel and a rapier band employed in a rapier loom as well as a weft inserting apparatus for the rapier loom. More particularly, the present invention is concerned with improved structures of the sprocket wheel and the rapier band which can ensure extended use or service life of the rapier band.

2. Description of Related Art

As is known in the art, in the rapier loom as shown in FIG. 17, a weft is inserted into a shedding formed between warps by inserting and retracting reciprocatingly a rapier head assembly into and from the shedding, which assembly is mounted on a tip or free end of a rapier band 12 which in turn is wound or wrapped around a sprocket wheel 11 driven with the rotating direction being reversible as can be seen in FIG. 17. The rapier head assembly is composed of a feeding rapier head 13 for catching the weft and pulling it into the shedding and a receiving rapier head 14 for receiving the weft from the feeding rapier head 13. The feeding rapier head 13 and the receiving rapier head 14 encounter each other substantially at the center as viewed in the direction widthwise of the woven fabric, whereupon the weft is transferred to the receiving rapier head 14 from the transferring rapier head 13. The weft inserting apparatus of the structure mentioned above is disclosed, for example, in Japanese Unexamined Patent Application Publication No. 216946/1984 (JP-A-59-216946).

Referring to FIG. 18A, there are formed in the rapier band 12 adapted to be wrapped around the sprocket wheel 11 a series of female holes 121 which mesh with teeth 111 of the sprocket wheel 11. In conjunction with the rapier band, it is noted that wall surfaces 122 of the female hole 121 undergo abrasion as time lapses, as can be seen in FIG. 18A. With reference to FIG. 18B, at a point P1, the wall surface 122 of the female hole 121 of the rapier band 12 does not contact with the tooth surface 112 of the tooth 111 of the sprocket wheel 11. Thus, no thrust is transmitted to the rapier band 12 in a wrapping section of the rapier band 12 where the rapier band 12 is wrapped on and around the sprocket wheel 11. The thrust for forcing the rapier band 12 to travel is transmitted thereto at a point P2 at which the tooth 111 of the sprocket wheel 11 disengages from the female hole 121 of the rapier band 12.

FIG. 18C is a view for explaining the reason why the wall surface 122 of the female hole 121 of the rapier band 12 undergoes abrasion. Referring to the figure, it is assumed that a line 112 represents a tooth surface of a tooth 111 which faces in opposition to a wall surface 122 of the female hole 121. In that case, when the base end of the tooth surface 112 is in contact with the base end of the wall surface 122 of the female hole 121, then the base end 123 of the wall surface 122 will displace for a distance given by R in the x-direction as the sprocket wheel 11 rotates clockwise by an angle $\alpha$. Parenthetically, R represents the radius of the sprocket wheel 11. Further, it is presumed that the rapier band 12 moves away from a dedendum circle 115 of the sprocket wheel 11 in the x-direction, starting from the position of the wall surface 122 indicated by a phantom line. The top end 114 of the tooth surface 112 of the tooth 111 moves to a position P(x, y) in the course of rotation of the sprocket wheel 11 for the angular distance $\alpha$. This position P(x, y) intrudes to the right-hand side beyond the wall surface 122 indicated by a solid line. A curve M represents the locus of the point P(x, y) and hence represents abrasion of the wall surface 122 of the female hole 121.

Representing the thickness of the rapier band 12 by h with inclination of the tooth surface 112 by $\beta$, the abrasion curve M may be given by the following expressions (1):

$$x=-R\alpha+(R+h)\sin\alpha-h\cdot\tan\beta\cdot\cos\alpha$$

$$y=-R+(R+h)\cos\alpha+h\cdot\tan\beta\cdot\sin\alpha \quad (1)$$

In the conventional weft inserting apparatus for the rapier loom, thrust is transmitted to the rapier band 12 from the tooth 111 when it disengages from the female hole 121 while sliding on the wall surface of the female hole 121, as indicated at P2 in FIG. 18B. The phenomenon of abrasion is brought about under concurrent actions of pressure and relative movement or sliding at a given speed. At any rate, it goes without saying that abrasion of the wall surface 122 of the female hole 121 shortens the use or service life of the rapier band 12.

SUMMARY OF THE INVENTION

In the light of the state of the art described above, it is an object of the present invention in its most broadest sense to extend or elongate the service life of the rapier band used in the rapier loom.

Another object of the present invention is to provide a sprocket wheel of an improved structure which can contribute to elongation of the service life of the rapier band.

Yet another object of the present invention is to provide a rapier band of an improved structure which can enjoy an extended service life.

It is a further object of the present invention to provide a rapier loom which is provided with a sprocket wheel of an improved structure which can ensure elongation of the useful life of a rapier band cooperating with the sprocket wheel.

In general, the present invention is directed to a rapier loom which includes a sprocket wheel having a plurality of teeth formed along an outer periphery thereof and mounted for reciprocating rotational motion, and a rapier band having a rapier head mounted at a tip end thereof and a plurality of holes formed therethrough so as to extend between an inner surface of the rapier band facing toward the sprocket wheel and an outer surface facing oppositely to the sprocket wheel, the rapier band being partially wrapped around the sprocket wheel with the teeth thereof meshing with the holes of the rapier band so that the rapier band is forced to travel reciprocatingly, thereby alternately inserting and retracting the rapier head assembly into and from a shedding formed by warps under the reciprocatingly rotation of the sprocket wheel.

In view of the aforementioned and other objects which will become apparent as the description proceeds, there is provided according to a general aspect of the present invention an improved structure of a sprocket wheel for the rapier loom mentioned above, in which each of the tooth surfaces of the tooth of the sprocket wheel located upstream and downstream alternately as viewed in the rotating directions of the sprocket wheel has a dedendum surface portion and an addendum surface portion differing in shape such that in a band meshing region in which the rapier band wraps around the sprocket wheel, the dedendum surface portion is brought into contact with the oppositely facing wall surface of the corresponding hole of the rapier band, while in a transitional region intervening between the meshing region and a band releasing region in which the rapier band gets free from interference of the teeth of the sprocket wheel, the dedendum surface portion does not contact with the wall surface of the corresponding hole of the rapier band, and wherein the addendum surface portion has such a shape that in the transitional region, the addendum surface portion is not brought into contact with the wall surface of the corresponding hole of the rapier band.

In a mode for carrying out the invention, it is preferred that in the sprocket wheel mentioned above, a boundary between the dedendum surface portion and the addendum surface portion of the tooth surface is positioned on a plane corresponding to an expansion/contraction-insusceptible layer of the rapier band which undergoes neither expansion nor contraction in the peripheral direction of the sprocket wheel even when the rapier band is wrapped around the sprocket wheel.

With the structure of the sprocket wheel, the teeth thereof transmit the driving force or thrust to the rapier band in the meshing region, while in the transitional region in which the teeth of the sprocket wheel disengage from the female holes of the rapier band, no thrust is transmitted to the rapier band. As mentioned previously, the phenomenon of abrasion takes place under coaction of pressure and relative sliding movement. In this conjunction, it will be appreciated that with the structure of the sprocket wheel described above, the wall surfaces of the female hole of the rapier band are not subjected to concurrent actions of pressure and relative sliding movement. Thus, no abrasion or wear can theoretically occur in the leading and trailing wall surfaces of the hole of the rapier band.

Further, in another preferred mode for carrying out the present invention, each of the wall surfaces of the female holes located upstream and downstream, respectively, as viewed in a traveling direction of the rapier band may be formed with an oblique plane so that portions of the hole wall surfaces located closer to the outer surface of the rapier band become closer to each other as viewed in the direction thicknesswise of the rapier band orthogonally to the traveling direction thereof when the rapier band is in a state not wrapped around the sprocket wheel.

According to yet another aspect of the present invention, there is provided a rapier loom which includes the sprocket wheel and the rapier band mentioned above. More specifically, in the sprocket wheel described above, each of the tooth surfaces of the tooth thereof located upstream and downstream alternately as viewed in the rotating directions of the sprocket wheel may be constituted by a dedendum surface portion and an addendum surface portion which differ in shape such that in the band meshing region in which the rapier band wraps around the sprocket wheel, the dedendum surface portion is brought into contact with the oppositely facing wall surface of the corresponding hole of the rapier band, while in the transitional region intervening between the meshing region and the band releasing region in which the rapier band gets free from interference of the teeth of the sprocket wheel, the dedendum surface portion does not contact with the wall surface of the corresponding female hole of the rapier band. To this end, the addendum surface portion may have such a shape that in the transitional region, the addendum surface portion is not brought into contact with the wall surface of the corresponding hole of the rapier band. On the other hand, in the rapier band, each of the wall surfaces of the holes located upstream and downstream, respectively, as viewed in the traveling direction of the rapier band may be formed with an oblique plane so that portions of the wall surfaces located closer to the outer surface of the rapier band become closer to each other as viewed in a direction thicknesswise of the rapier band orthogonally to the traveling direction thereof when the rapier band is in a state not wrapped around the sprocket wheel.

With the structure of the rapier loom described above, the dedendum surface portion of the tooth of the sprocket wheel contacts with the opposite wall surface of the corresponding hole of the rapier band in the meshing region where the rapier band is wrapped on and around the sprocket wheel. However, in the transitional region, the dedendum surface portion of the tooth will not intrude into the wall surface of the female hole. Thus, the teeth of the sprocket wheel are prohibited from abrading the wall surfaces of the female holes of the rapier band.

In another preferred mode for implementing the sprocket wheel according to the present invention, the dedendum surface portion of the tooth surface should preferably be imparted with such shape which substantially matches with that of the wall portion of the female hole which is located underneath the plane corresponding to the expansion/contraction-insusceptible layer of the rapier band and which undergoes deformation under pressure applied thereto when the rapier band is wrapped around the sprocket wheel. By virtue of the arrangement mentioned above, the wall surface portions of the female hole located underneath the expansion/contraction-insusceptible layer of the rapier band can receive snugly the leading and trailing tooth surfaces of the sprocket wheel in the wrapping section where the rapier band is wrapped around the sprocket wheel.

In yet another preferred mode for carrying out the invention, a major part of the dedendum surface portion of the tooth surface of the sprocket wheel may be formed as an oblique plane which approximates a shape of a wall portion of the hole which is located underneath the plane corresponding to the expansion/contraction-insusceptible layer of the rapier band and which undergoes deformation under pressure applied thereto when the rapier band is wrapped around the sprocket wheel. The configuration mentioned above is advantageous for realizing the engagement between the teeth of the sprocket wheel and the female holes of the rapier band without being accompanied with abrasion.

Further in the sprocket wheel mentioned above, the addendum surface portion of each of the tooth surfaces can have a curved surface formed with an involute curve so that a pressure angle (i.e., angle of obliquity of action) on a boundary between the dedendum surface portion and the addendum surface portion has a value equal to or greater than a value of an angle formed between the wall surface of the hole of the rapier band and a center axis of the hole when the rapier band is in a state not wrapped around the sprocket wheel.

The tooth surface of the sprocket wheel may be generated by translating the involute curve in the direction thicknesswise of the sprocket wheel. The leading and trailing tooth surfaces each generated with the involute curve can move away from the trailing and leading wall surfaces of the female hole as the latter moves away from the dedendum or root circle in the transitional region. Consequently, the wall surfaces of the hole can positively be protected against abrasion.

In this conjunction, the base circle for the involute curve should preferably have a radius which is shorter than a radius of the dedendum circle of the teeth of the sprocket wheel. More specifically, the involute curve may be generated on the basis of a base circle having a center on the radius of the sprocket wheel. By generating the involute curve, starting from the base circle having a radius smaller than that of the dedendum or root circle of the sprocket wheel according to the teaching of the invention, the area of the hole subjected to the pressure exerted by the teeth can be increased.

In this case, the base circle for the involute curve should preferably be set so as to have a radius which is equal to a radius of the dedendum circle of the teeth of the sprocket wheel so that the tooth surface of the tooth and the wall surface of the female hole can contact with each other at the base end in the wrapping section.

The dedendum surface portions of the tooth surfaces of the tooth of the sprocket wheel may have respective base end portions lying on the involute curves, respectively, while the other surface portions of the dedendum surface portions than the base end portions may have respective curved surfaces formed with the involute curves located inwardly relative to the involute curves.

Parenthetically, each of the holes of the rapier band may be formed as a vertical hole. In that case, distance between the base end portions of tooth surfaces of the sprocket wheel should preferably not be shorter than a distance between the wall surfaces of the hole of the rapier band in the state where the rapier band is wrapped around the sprocket wheel. Because of this, the portion in the vicinity of the base end of the vertical hole can be brought into contact with the teeth of the sprocket wheel under elastic deformation or pressure traction.

Further, the portions of the wall surfaces of the hole formed in the rapier band and located beneath the plane corresponding to the expansion/contraction-insusceptible layer may be formed in a flaring configuration so that bottom end portions of the dedendum surface portions of the tooth of the sprocket wheel can be brought into contact with portions of the wall surfaces of the hole of the rapier band when the rapier band is in the state wrapped around the sprocket wheel. In this case, the portion in the vicinity of the base end of the vertical hole can be brought into contact with the teeth of the sprocket wheel under elastic deformation or pressure traction.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

FIG. 5 is a schematic diagram for illustrating a manner in which curved surfaces of a tooth surface of the sprocket wheel are determined in accordance with teachings of the present invention incarnated in the third embodiment;

FIG. 5A is an enlargement of the circled portion 5A in FIG. 5;

FIG. 10 is a schematic diagram for illustrating a manner in which curved surfaces of a tooth surface of the sprocket wheel are determined in accordance with teachings of the present invention incarnated in the third embodiment;

FIG. 10A is an enlargement of the circled portion 10A in FIG. 10;

DESCRIPTION OF THE PREFERRED EMBODIMENTS

Figure 1:
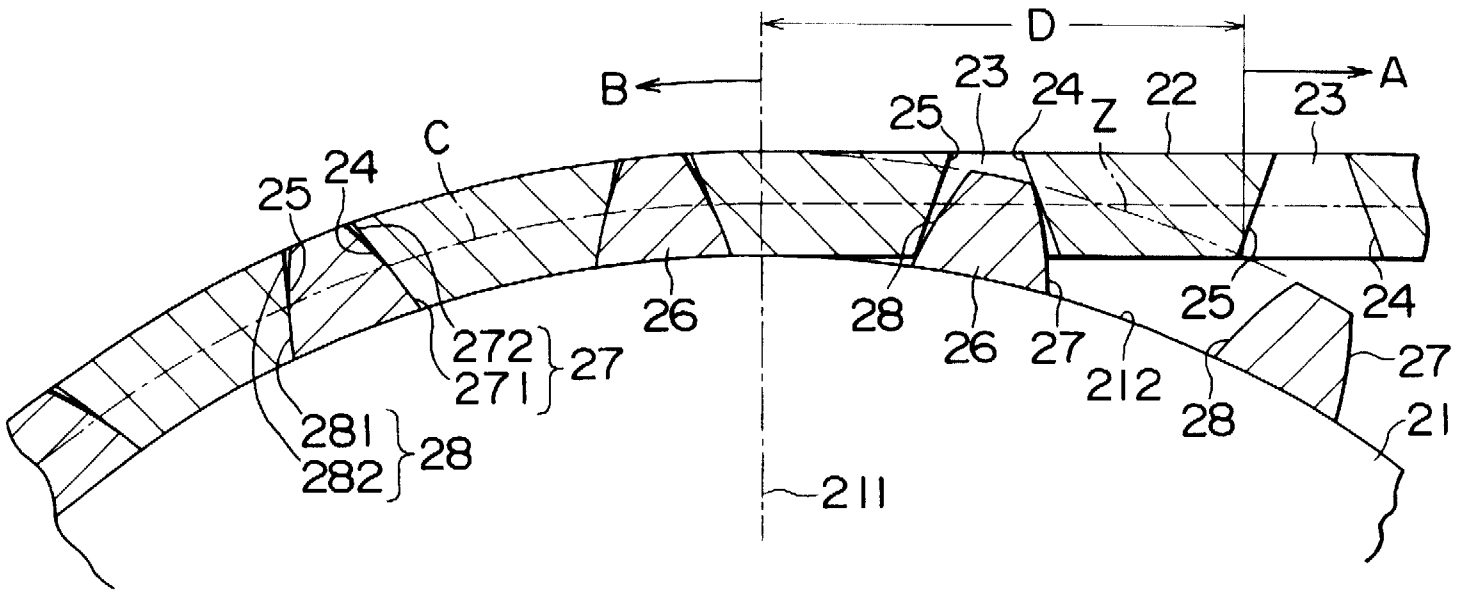
FIG. 1 is a side elevational view showing in a vertical section major portions of a rapier band and a sprocket wheel according to a first embodiment of the invention in the state where the rapier band is wrapped around a sprocket wheel.

Now, the present invention will be described in detail in conjunction with what is presently considered as preferred embodiments thereof by reference to the drawings. In the following description, like reference characters designate like or corresponding parts throughout the several views. Also in the following description, it is to be understood that such terms as "vertically", "leading", "trailing", "left", "right", "top", "bottom" and the like are words of convenience and are not to be construed as limiting terms.

Embodiment 1

Referring to FIGS. 1, 2A to 2C and 3 to 5, a first embodiment incarnating the teachings of the present invention will be described.

FIG. 1 is a view showing a rapier band 22 in the state wound or wrapped around a sprocket wheel 21. In the figure, reference numeral 211 designates a radial line of the sprocket wheel 21, and a dotted-broken line Z represents an addendum circle of the sprocket wheel 21. A non-wrapping section of the rapier band 22 which is not in contact with teeth 26 of the sprocket wheel 21 is designated by an arrow A shown in FIG. 1 at the right-hand side of the radial line 211, while a wrapping section of the rapier band 22 in which the band 22 is wrapped around the sprocket wheel 21 is designated by an arrow B shown at the left-hand side of the radial line 211. Further, reference character D designates a transitional section of the rapier band 22 which is located between the wrapping section and the non-wrapping section. In the transitional state, female holes 23 formed in the rapier band 22 are brought into meshing contact or engagement with the teeth 26 of the sprocket wheel 21. Additionally, a dotted line C shown at a center as viewed in the direction thicknesswise of the rapier band 22 represents an invariable layer of the rapier band 22 which is insusceptible to expansion or contraction regardless of whether the rapier band 22 is in a bent state or non-bent state.

Figure 2A:
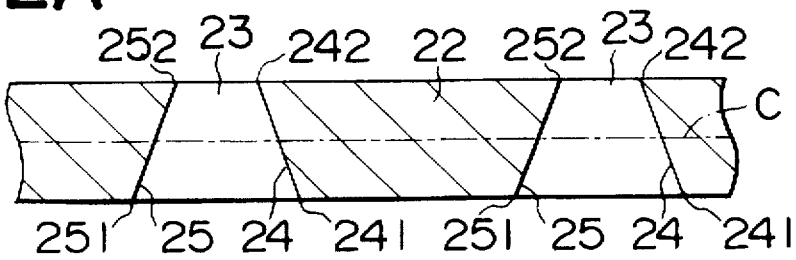
FIG. 2A is a view showing the rapier band in a state not wrapped around the sprocket wheel.
Figure 2B:
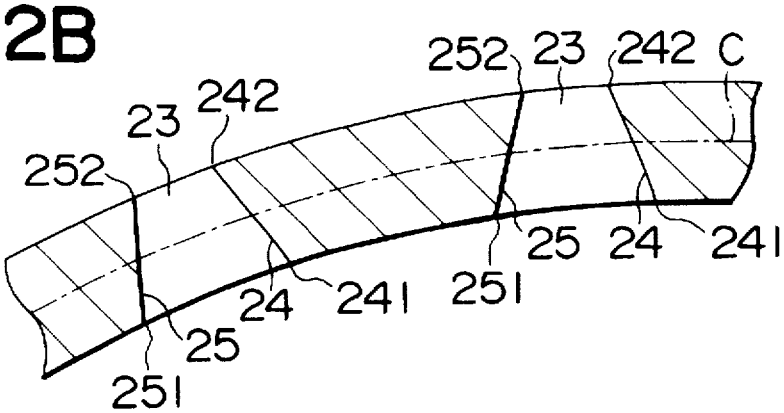
FIG. 2B is a view showing the rapier band in the state wrapped around the sprocket wheel.

FIG. 2A is a view showing the rapier band 22 in the non-wrapping section. On the other hand, FIG. 2B shows the wrapping section of the rapier band 22. As can be seen in FIG. 2A, the rapier band 22 is formed with a series of female holes 23 each having a shape of truncated prism. As will be understood from a comparison of FIGS. 2A and 2B, when the rapier band 22 reaches a sprocket wrapping position to enter into the wrapping section or state mentioned above, base ends 241 and 251 of leading and trailing surface walls 24 and 25, respectively, of the female holes 23 displace toward each other, while top ends 242 and 252 of the walls 24 and 25 tend to move away from each other. However, the length of the expansion/contraction-insusceptible layer C between the wall surfaces 24 and 25 remains constant or invariable i.e., without undergoing any expansion or contraction.

Figure 2C:
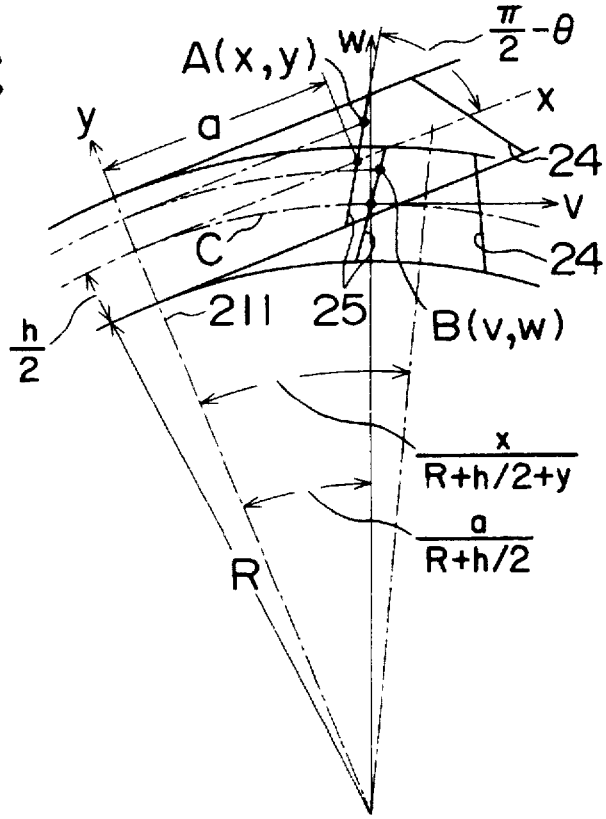
FIG. 2C is a view for illustrating deformation of a female hole formed in the rapier band, which deformation is brought about when the rapier band is wrapped around the sprocket wheel.

FIG. 2C is a view for illustrating deformation of the female hole 23 which is brought about when the rapier band 22 is bent curvilinearly. In the figure, coordinate A (x, y) represents a single point located on the wall surface 25 of the female hole 23 in the non-wrapping section of the rapier band 22, while coordinate B (v, w) indicates a position to which the point A (x, y) is displaced upon transition of the hole 23 from the non-wrapping section or state to the wrapping state. When inclination of the wall surface 25 relative to the expansion/contraction-insusceptible layer C in the state in which the rapier band 22 extends linearly is represented by, $(\pi/2-\theta)$ then the wall surface 25 can be represented by the following expression (2) in the x-y coordinate system.

$$y=(x-a)\tan(\pi/2-\theta) \quad (2)$$

On the other hand, representing the radius of the sprocket wheel 21 by R with the thickness of the rapier band 22 by h, the wall surface 25 can be given by the following expression in a v, w coordinate system when the rapier band 22 is located in the wrapping section.

$$v=(R+h/2+y)\sin[x/(R+h/2+y)-a/(R+h/2)]$$

$$w=(R+h/2+y)\cos[x/(R+h/2+y)-a/(R+h/2)]-R-h/2 \quad (3)$$

Figure 3:
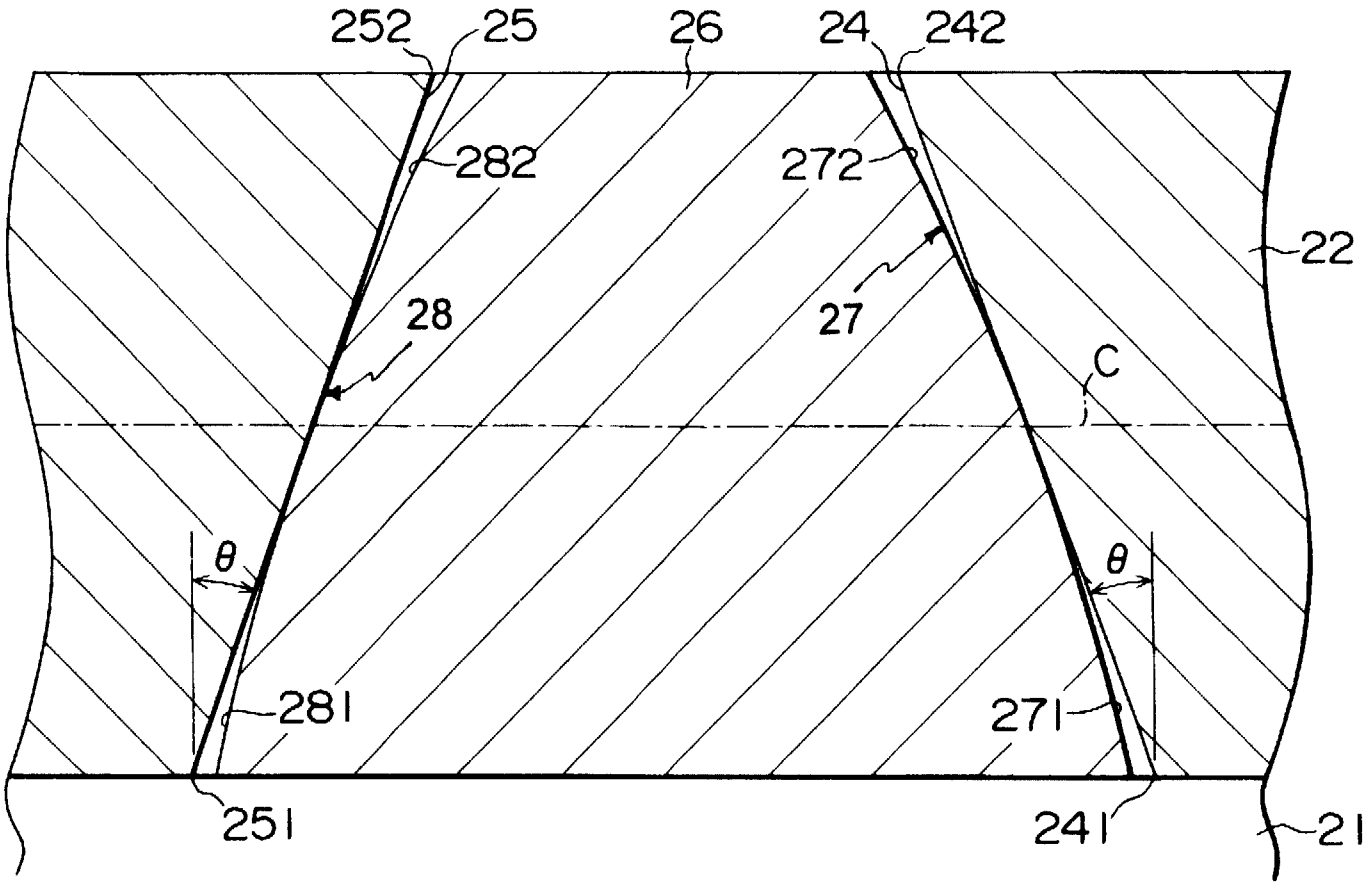
FIG. 3 is an enlarged vertical sectional view showing a major portion of the rapier band in a non-wrapping state on the assumption that a tooth of the sprocket wheel is inserted into a female hole formed in the rapier band.
Figure 4:
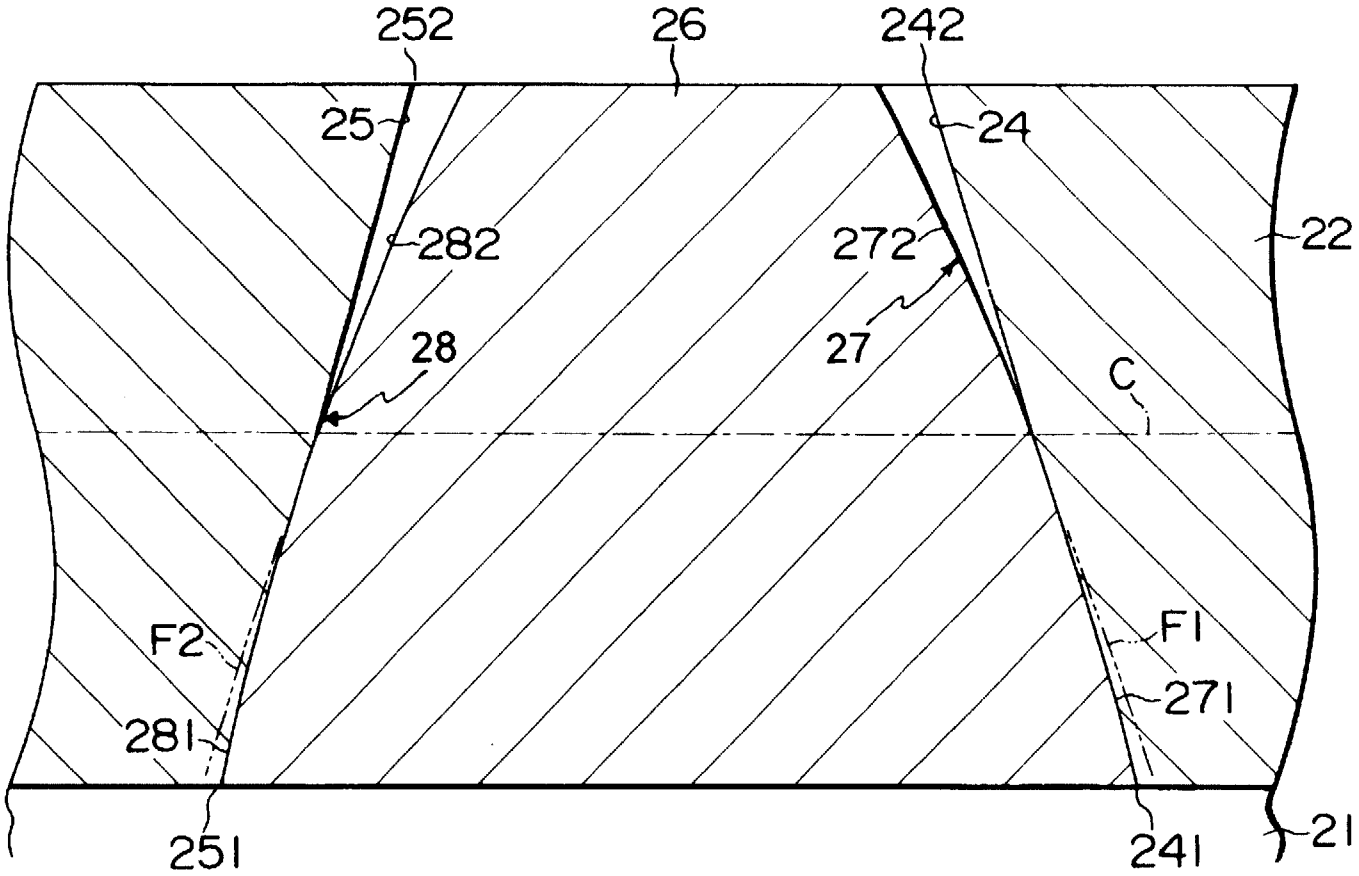
FIG. 4 is an enlarged vertical sectional view showing the rapier band in a wrapping state in which a tooth of the sprocket wheel meshes with a female hole formed in the rapier band, being inserted therein.

FIG. 3 shows the rapier band 22 in an assumed state where a tooth 26 of the sprocket wheel 21 is inserted into a female hole 23 formed in the rapier band 22 at the non-wrapping section, only for the purpose of illustrating the principle underlaying the invention. On the other hand, FIG. 4 illustrates a meshing state in which a tooth of the sprocket wheel 21 meshes with the female hole 23 formed in the rapier band 22, being inserted therein, at the wrapping section. In the state illustrated in FIG. 3, a leading tooth surface 27 and a trailing tooth surface 28 of the tooth 26 make contact with the wall surfaces 24 and 25, respectively, of the female hole 23 on a plane corresponding to the expansion/contraction-insusceptible layer C. On the other hand, in the state illustrated in FIG. 4, the tooth surfaces 27 and 28 of the tooth 26 are brought into contact with the wall surfaces 24 and 25, respectively, of the female hole 23 at portions 271 and 281 located beneath the expansion/contraction-insusceptible layer C as viewed in the direction heightwise of the tooth.

Each of the tooth surfaces 27 and 28 of the tooth 26 presents a curvilinear or curved surface generated by using an involute curve. The portions 271 and 281 of the tooth surfaces 27 and 28 located beneath the expansion/contraction-insusceptible layer C geometrically coincide or match with the wall surfaces 24 and 25, respectively, of the female hole 23. Owing to such geometric configuration, only the portions 271 and 281 of the tooth surfaces 27 and 28 located beneath the expansion/contraction-insusceptible layer C are brought into contact with the wall surfaces 24 and 25, respectively, of the female hole 23 of the rapier band 22 at the wrapping section, while in the non-wrapping section, the wall surfaces 24 and 25 of the female hole 23 formed in the rapier band 22 are disabled from contacting the tooth surfaces 27 and 28, respectively. More specifically, the portions 271 and 281 of the tooth surfaces 27 and 28 located below the expansion/contraction-insusceptible layer C are formed in an interference configuration so that these portions 271 and 281 are brought into contact with the wall surfaces 24 and 25, respectively, of the female hole 23 at the wrapping section thereof, while in the non-wrapping section, the tooth surfaces 27 and 28 do not contact with the wall surfaces 24 and 25, respectively. On the other hand, portions 272 and 282 of the tooth surfaces 27 and 28 located above the plane corresponding to the expansion/contraction-insusceptible layer C are formed in a non-interference configuration so as not to contact with the wall surfaces 24 and 25, respectively, of the female hole 23.

FIGS. 5 and 5A are schematic diagrams for illustrating a manner in which the curved surface of the non-interference portions 272 and 282 of the tooth surfaces 27 and 28, respectively, are generated. Referring to the figures, a point or position Q corresponds to a center of curvature of a dedendum circle 212 of the sprocket wheel 21. Further, reference character E1 designates a base circle for the involute curve, the center of which corresponds to the position Q. At this junction, it should be mentioned that the radius of the base circle E1 is designed to be shorter than that of the dedendum circle 212. A line segment S1 is equivalent to a yarn which is assumed as being wound around the base circle E1 and extending therefrom in the tangential direction over a length equal to a corresponding circular arc length. The locus of the tip end of the line segment S1 can be represented by an involute curve F1. A tip end of the line segment S1 corresponding to a radial line H1 which is equivalent to a radial line H of the base circle E1 (i.e., a line segment H corresponding to the radius of the base circle E1) displaced angularly by an angle θ is positioned on the plane defined by the expansion/contraction-insusceptible layer C. By translating the involute curve F1 generated in this manner in the direction thicknesswise of the sprocket wheel 21, a curved surface is obtained which is adopted as the geometrical configuration for the non-interference portion 272 of the tooth surface 27. In FIG. 5, a curve F2 represents an involute curve which is generated in the direction opposition to the involute curve F1. By translating the involute curve F2 in the direction thicknesswise of the tooth 26, a curved surface is formed a part of which constitutes the non-interference portion 282 of the tooth surface 28. A dotted straight line L1 represents the wall surface 24 of a female hole 23 formed in the rapier band 22 at the wrapping section. The involute curve F1 contacts with the dotted straight line L1 on the expansion/contraction-insusceptible layer C.

When the rapier band 22 lies in the wrapping section, as shown in FIG. 4, the base ends 241 and 251 of the wall surfaces 24 and 25 of the female hole 23 are forced to displace toward each other while the top ends 242 and 252 of the wall surfaces 24 and 25 move away from each other. In this state, the wall surfaces 24 and 25 are positioned at the inner side relative to the involute curves F1 and F2, respectively. The geometrical configuration of each portion 271, 281 conforms with the deformed shape of the respective wall surfaces 24, 25 of the female hole 23 at the wrapping section. By shaping each portion 271, 281 in the above mentioned configuration, each wall surface 24, 25 of the female hole 23 fits snugly with the portion 271, 281 at the wrapping section of the rapier band 22. Besides, at the non-wrapping section of the rapier band 22, each wall surface 24, 25 of the female hole 23 is brought into contact with the respective tooth surfaces 27, 28 of the tooth 26 only on the plane corresponding to the expansion/contraction-insusceptible layer C, as can be seen in FIG. 3. Accordingly, when the sprocket wheel 21 is rotated in the clockwise direction, as viewed in FIG. 1, the tooth 26 disengages from the female hole 23 without abrading the wall surfaces 24, 25 of the female hole 23 as the tooth 26 moves away from the radial line 211 in the direction indicated by the arrow A at the transitional section. Thus, the wall surfaces 24 and 25 of the female hole 23 can be protected against wear due to abrasion by the tooth 26, whereby the useful or service life of the rapier band 22 can significantly be elongated.

Embodiment 2

A second embodiment of the present invention will be described by reference to FIG. 6 in which parts the same as or equivalent to those of the first embodiment are denoted by like reference symbols.

Figure 6:
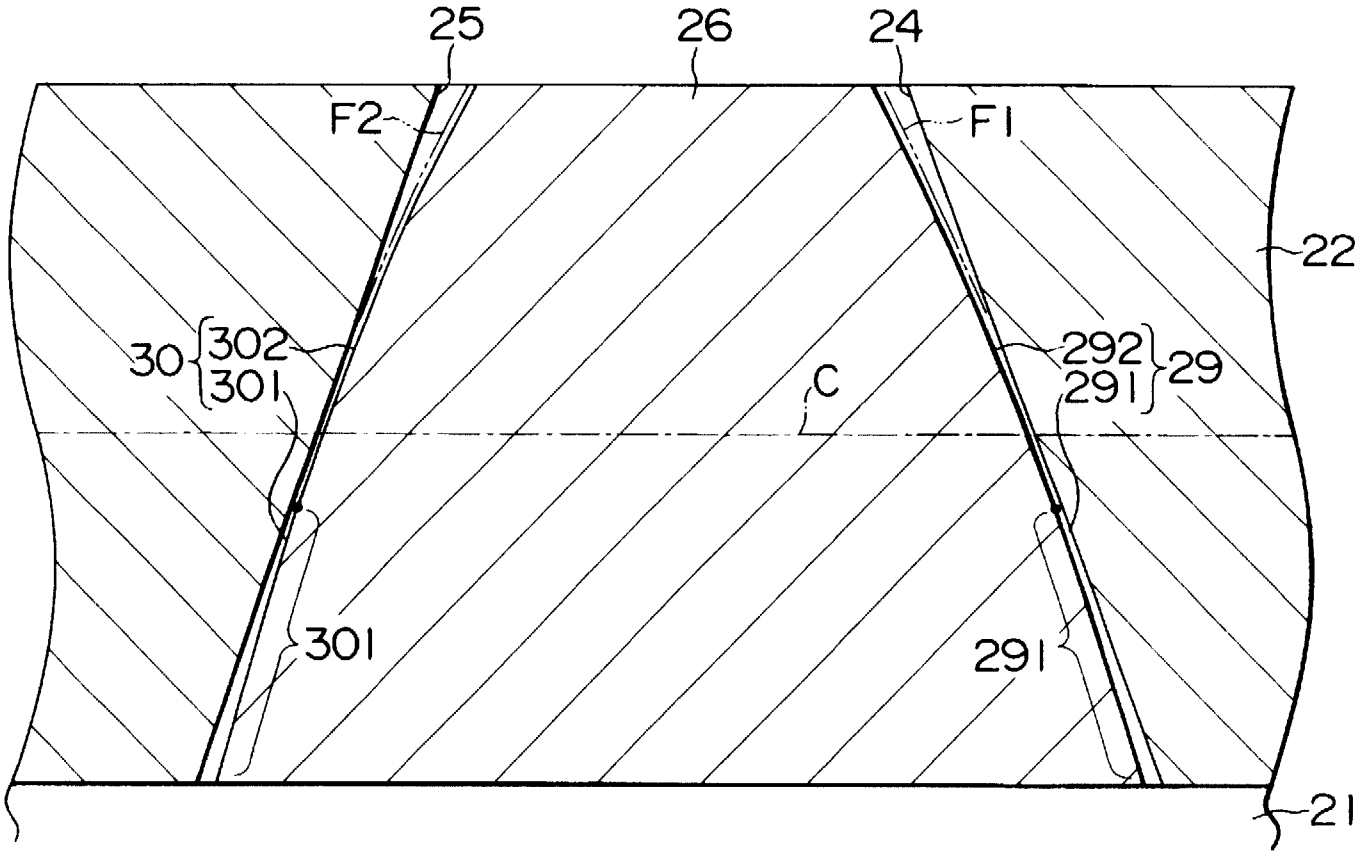
FIG. 6 is an enlarged vertical sectional view showing major portions of a rapier band and a sprocket wheel according to a second embodiment of the invention.
Figure 7:
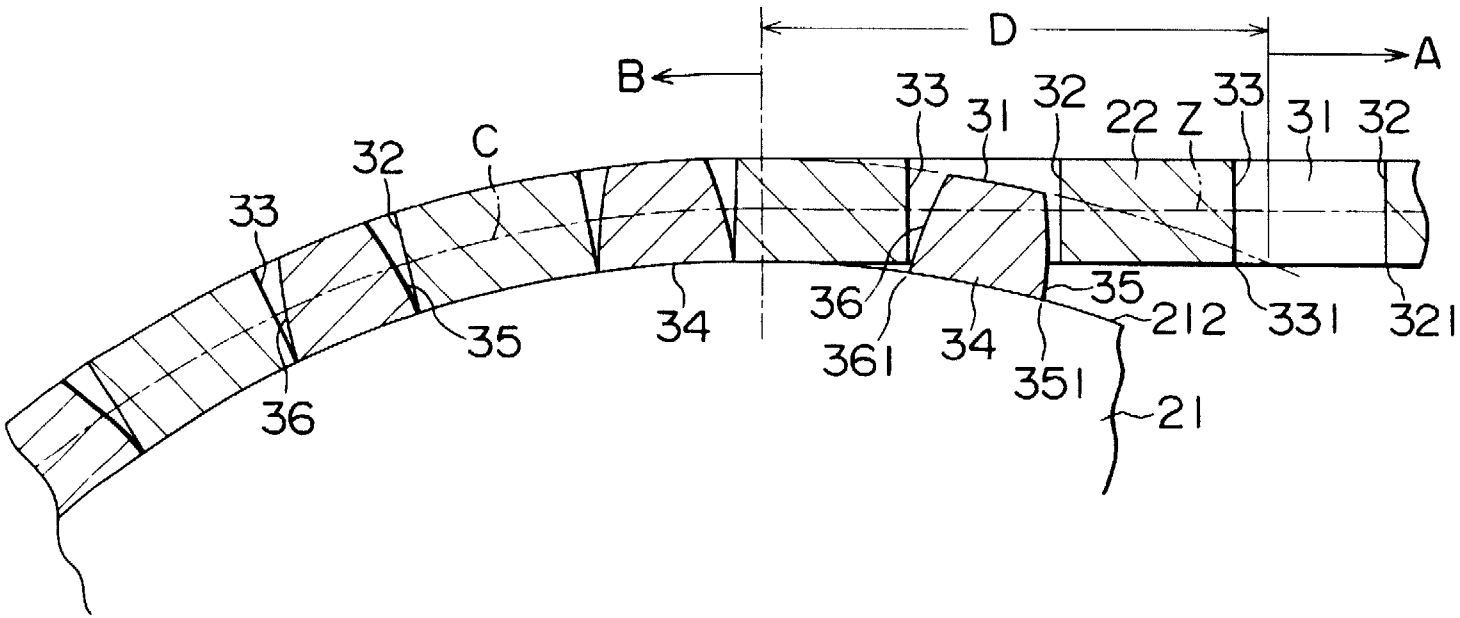
FIG. 7 is a side elevational view showing in a vertical section a rapier band and a sprocket wheel according to a third embodiment of the present invention.

FIG. 6 is a sectional view showing a non-wrapping section of a rapier band 22 according to the instant embodiment of the invention. Tooth surfaces 29 and 30 of the tooth 26 have non-interference portions 292 and 302 presenting curved surfaces generated by involute curves which are slightly offset inwardly relative to the involute curves F1 and F2 contacting the wall surfaces 24 and 25, respectively, of the female hole 23. In the case of the first embodiment of the invention, the involute curve having a pressure angle (i.e., angle of obliquity of action) equal to the inclination or oblique angle θ of the female hole of the rapier band in the non-wrapping section is used at a boundary position between the upper non-interference portion 272, 282 and the lower interference portion 271, 281. By contrast, in the case of the second embodiment of the invention, the involute curve having the pressure angle greater than the angle θ is employed for generating the curved surfaces of the upper non-interference portion 292, 302. On the other hand, each interference portion 291, 301 of the tooth surface 29, 30 is realized in the form of an oblique plane approximating the shape of the interference portion 271, 281 described hereinbefore in conjunction with the first embodiment of the invention.

With the structure of the second embodiment described above, there can be achieved similar advantageous actions or effects as in the case of the first embodiment. Moreover, by slightly offsetting inwardly each non-interference portion 292, 302 when compared with the portion 272, 282, smoothness in the intermeshing of the female hole 23 and the tooth 26 can be enhanced. Furthermore, implementation of each interference portion 291, 301 in the form of the slanted plane, as mentioned above, shaping or machining of each tooth surface 29, 30 can be facilitated, to a further advantage.

Embodiment 3

Next, a third embodiment of the present invention will be described by reference to FIGS. 7 to 10 in which parts the same as or equivalent to those of the first embodiment are denoted by like reference symbols.

Figure 8:
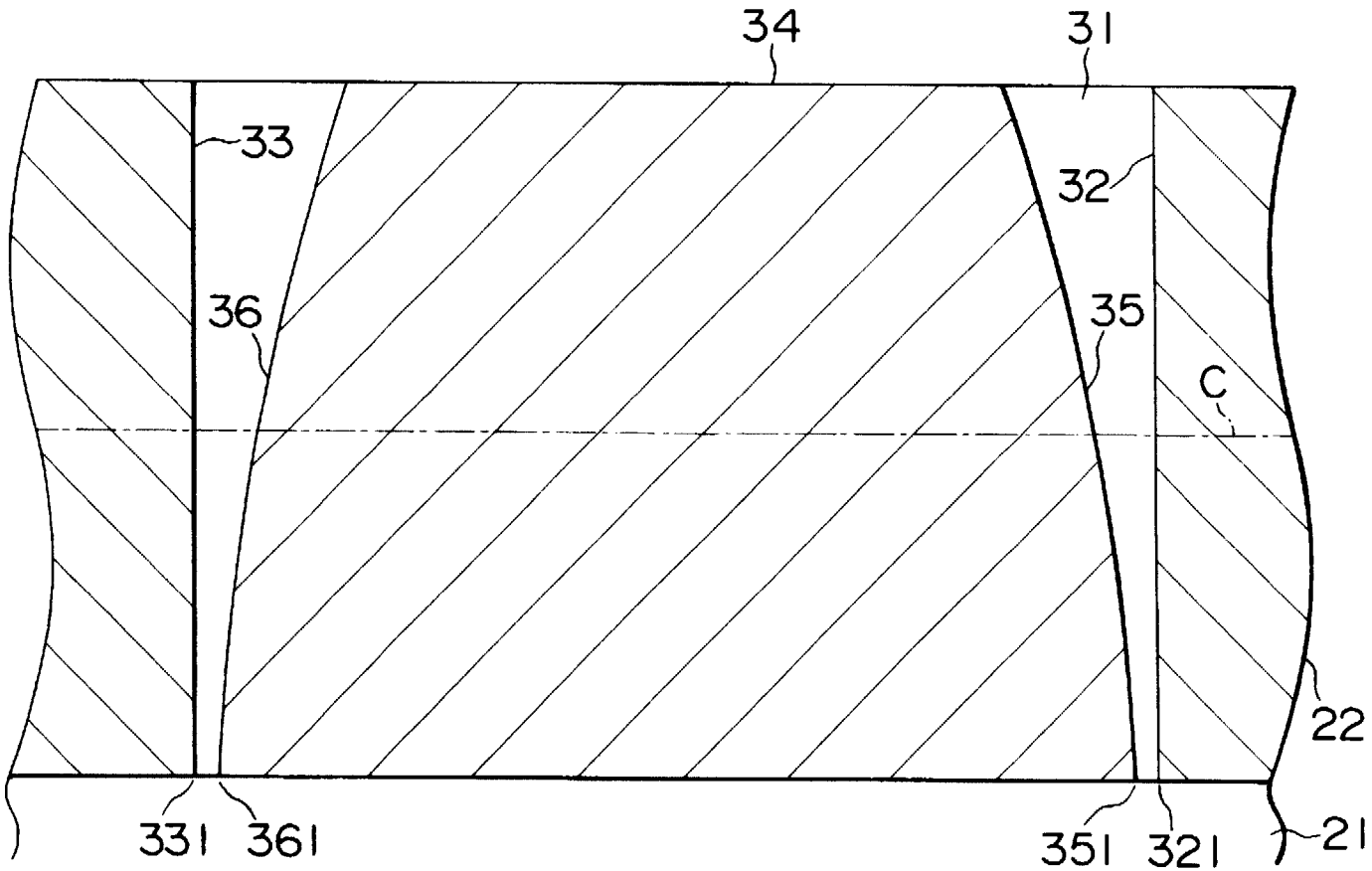
FIG. 8 is an enlarged vertical sectional view showing a major portion of the rapier band in a non-wrapping section.
Figure 9:
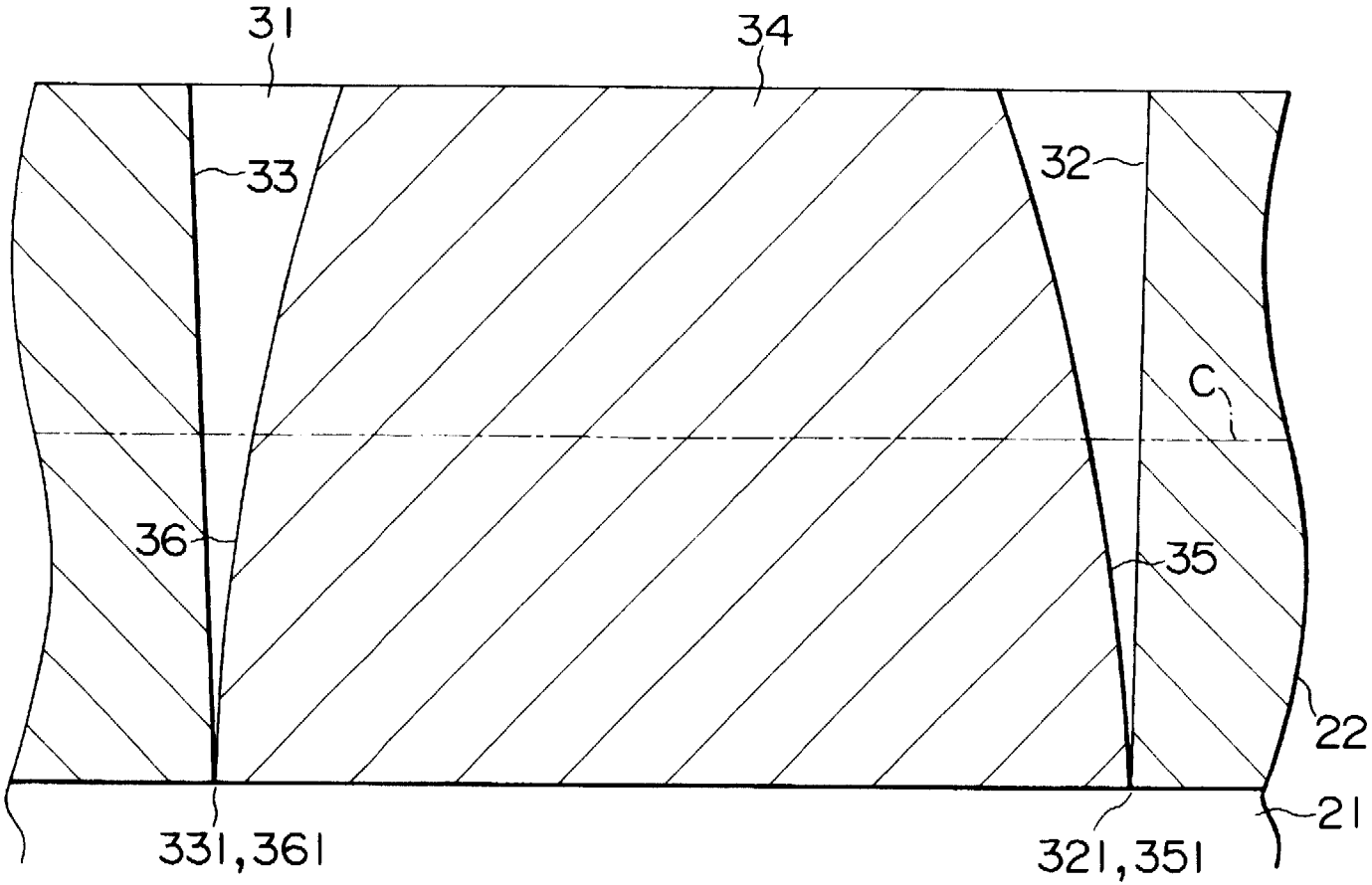
FIG. 9 is an enlarged vertical sectional view showing a major portion of the rapier band in a wrapping section.

In the drawings mentioned above, FIG. 8 shows the rapier band 22 according to the instant embodiment at the non-wrapping section, while FIG. 9 shows the same at the wrapping section. Parenthetically, it should be mentioned that in the practical applications, there arises no such situation in which teeth 34 penetrate into female holes 31 of the rapier band 22 at the non-wrapping section. The state illustrated in FIG. 8 is supposed only for the convenience of description. As can be seen in the non-wrapping section, the female hole 31 assumes the form of a rectangular vertical hole with wall surfaces 32 and 33 of the female hole 31 extending orthogonally relative to the plane defined by the expansion/contraction-insusceptible layer C.

Each of the leading and trailing tooth surfaces 35 and 36 of the tooth 34 of the sprocket wheel 21 is imparted with a curved surface generated by translating an involute curve in the direction thicknesswise of the teeth 34.

FIGS. 10 and 10A are views for illustrating generation of involute curves F3 and F4 for forming or shaping the tooth surfaces 35 and 36, respectively. Referring to the figures, a point or position Q corresponds to a center of curvature of a dedendum circle 212 of the sprocket wheel 21. Further, reference character E2 designates a base circle, the center of which corresponds to the position Q. A line segment S2 is formed by developing a corresponding circular arc in the direction tangentially of the basic circle E2. The dotted straight line L2 represents the wall surface 32 of the female hole 31. The involute curve F3 starts from the intersection between the base circle E2 and the radial line H. The involute curve F4 is generated in a similar manner as the involute curve F3 but in the direction opposite to that of the latter.

With reference to FIG. 9, the distance between base ends 351 and 361 of the tooth surfaces 35 and 36 generated with the involute curves F3 and F4, respectively, is so selected that the base ends 351 and 361 are brought into contact with the base ends of the wall surfaces 32 and 33 of the female hole 31 in the wrapping section of the rapier band 22. By forming or shaping the tooth surfaces 35 and 36 of the teeth 34 in this manner, the wall surfaces 32 and 33 of the female hole 31 are protected against abrasion by the teeth 34 of the sprocket. Thus, the rapier band 22 according to the instant embodiment of the invention can enjoy an extended useful life, as in the case of the rapier band according to the first embodiment described hereinbefore. It is however noted that the surface or contact pressure acting between each wall surface 32, 33 of the female hole 31 and the respective tooth surfaces 35, 36 of the tooth 34 increases when compared with the structure according to the first embodiment of the invention. However, it is important to note that abrasion of the wall surface 32, 33 of the female hole 31 can be significantly mitigated or reduced when compared with the conventional structure because the load can be distributed to a large number of teeth 34 in the wrapping section and because application of the load and relative sliding movement can not occur concurrently.

Embodiment 4

Figure 11:
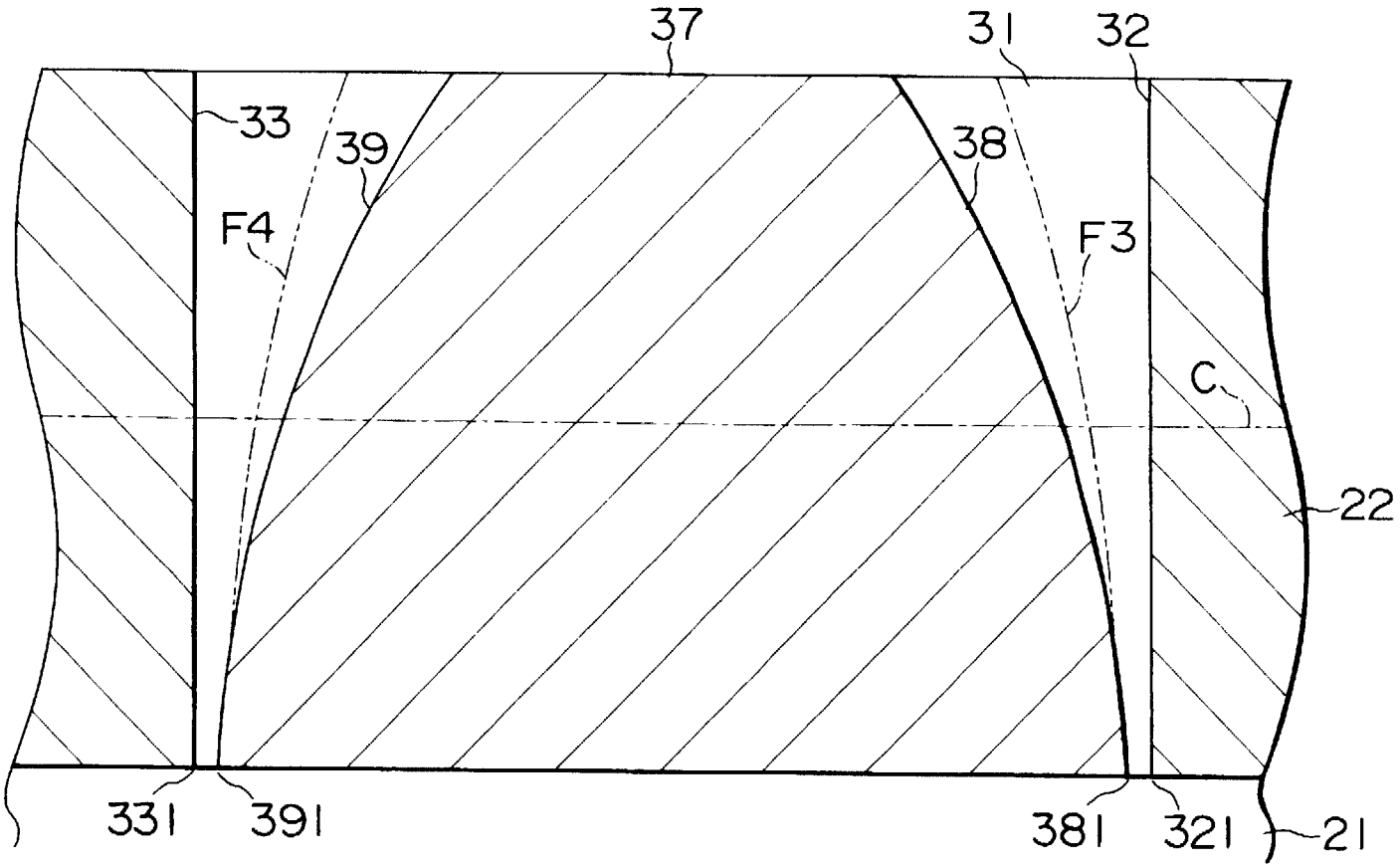
FIG. 11 is a side elevational view showing in a vertical section a rapier band and a sprocket wheel according to a fourth embodiment of the present invention.

Further, a fourth embodiment of the present invention will be described by reference to FIG. 11 in which parts the same as or equivalent to those of the third embodiment are denoted by like reference symbols.

In the structure according to the instant embodiment of the invention, tooth surfaces 38 and 39 of the tooth 37 of the sprocket wheel 21 are offset inwardly when compared with the tooth surfaces 35 and 36 described previously in conjunction with the third embodiment of the invention. However, the distance between the base ends 381 and 391 of the tooth surfaces 38 and 39, respectively, are designed essentially same as the corresponding distance in the structure according to the third embodiment. With the structure of the sprocket wheel according to the instant embodiment, the useful life or service life of the rapier band 22 can be elongated because the wall surfaces 32 and 33 of the female hole 31 are protected against wear due to the abrasion by the teeth 37 of the sprocket wheel 21. It is however noted that the surface or contact pressure acting between each wall surface 32, 33 of the female hole 31 and the tooth surfaces 38, 39 of the tooth 37 increases when compared with the structure according to the third embodiment of the invention. However, it is important to note that abrasion of the wall surfaces 32, 33 of the female hole 31 can be significantly mitigated or reduced when compared with the conventional structure because the load can be distributed to a large number of teeth 37 in the wrapping section and because application of the load and relative sliding movement can not occur simultaneously.

Embodiment 5

Figure 12:
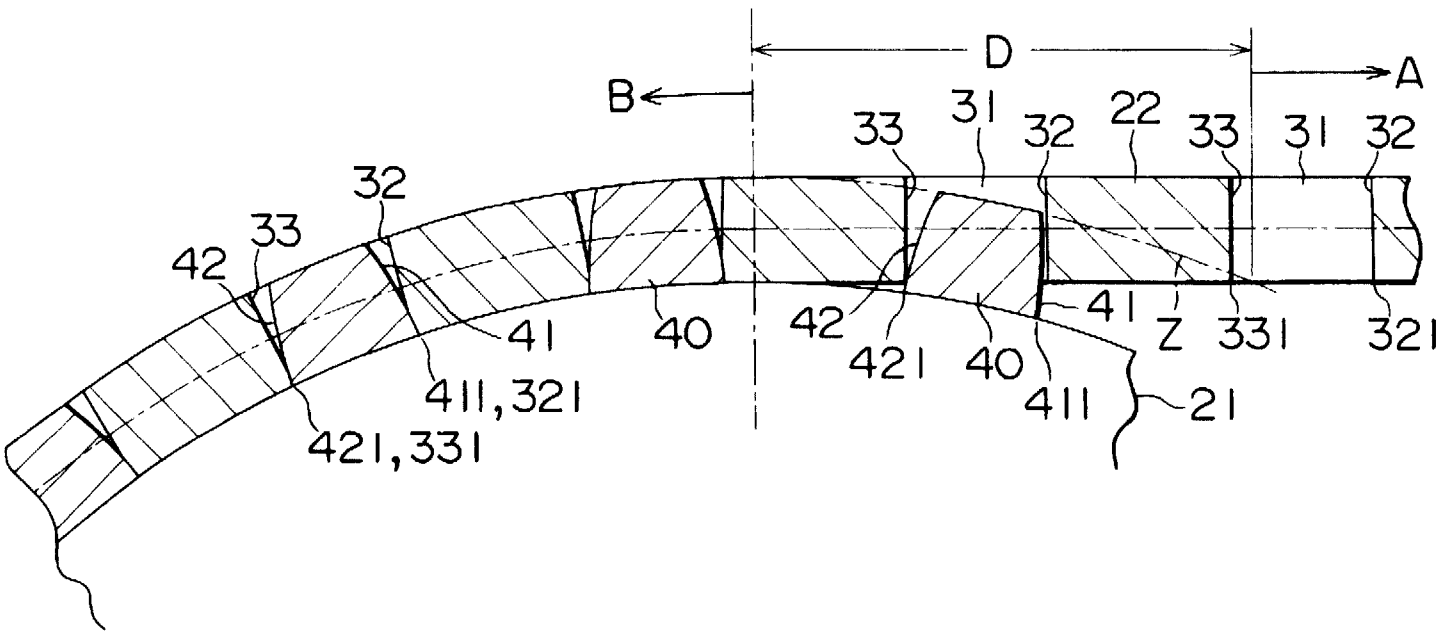
FIG. 12 is a side elevational view showing in a vertical section a rapier band and a sprocket wheel according to a fifth embodiment of the present invention.
Figure 13:
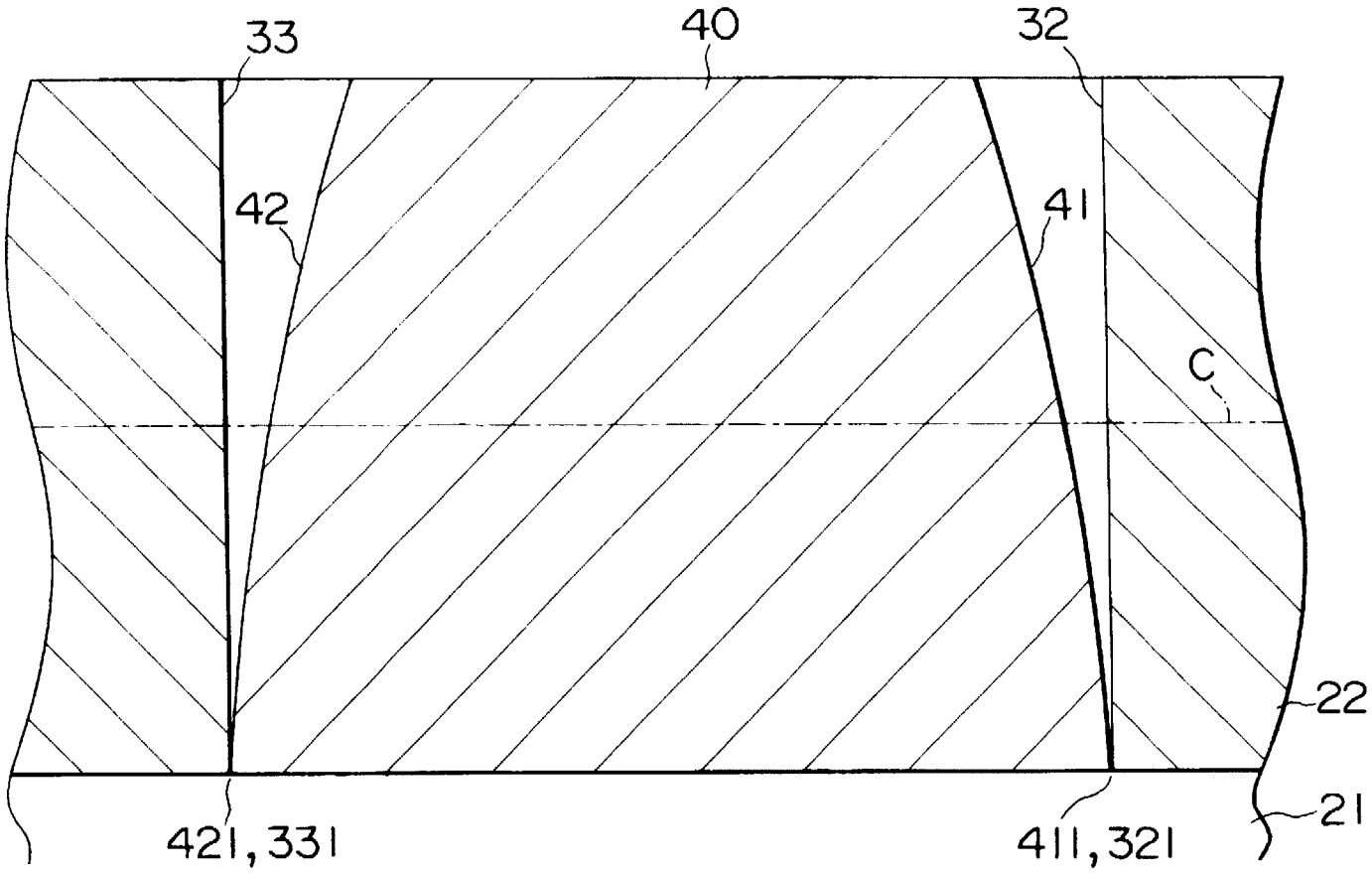
FIG. 13 is an enlarged vertical sectional view showing a major portion of the rapier band in a non-wrapping section.

Next, a fifth embodiment of the present invention will be described by reference to FIGS. 12 to 14 in which parts the same as or equivalent to those of the third embodiment are denoted by like reference symbols.

Figure 14:
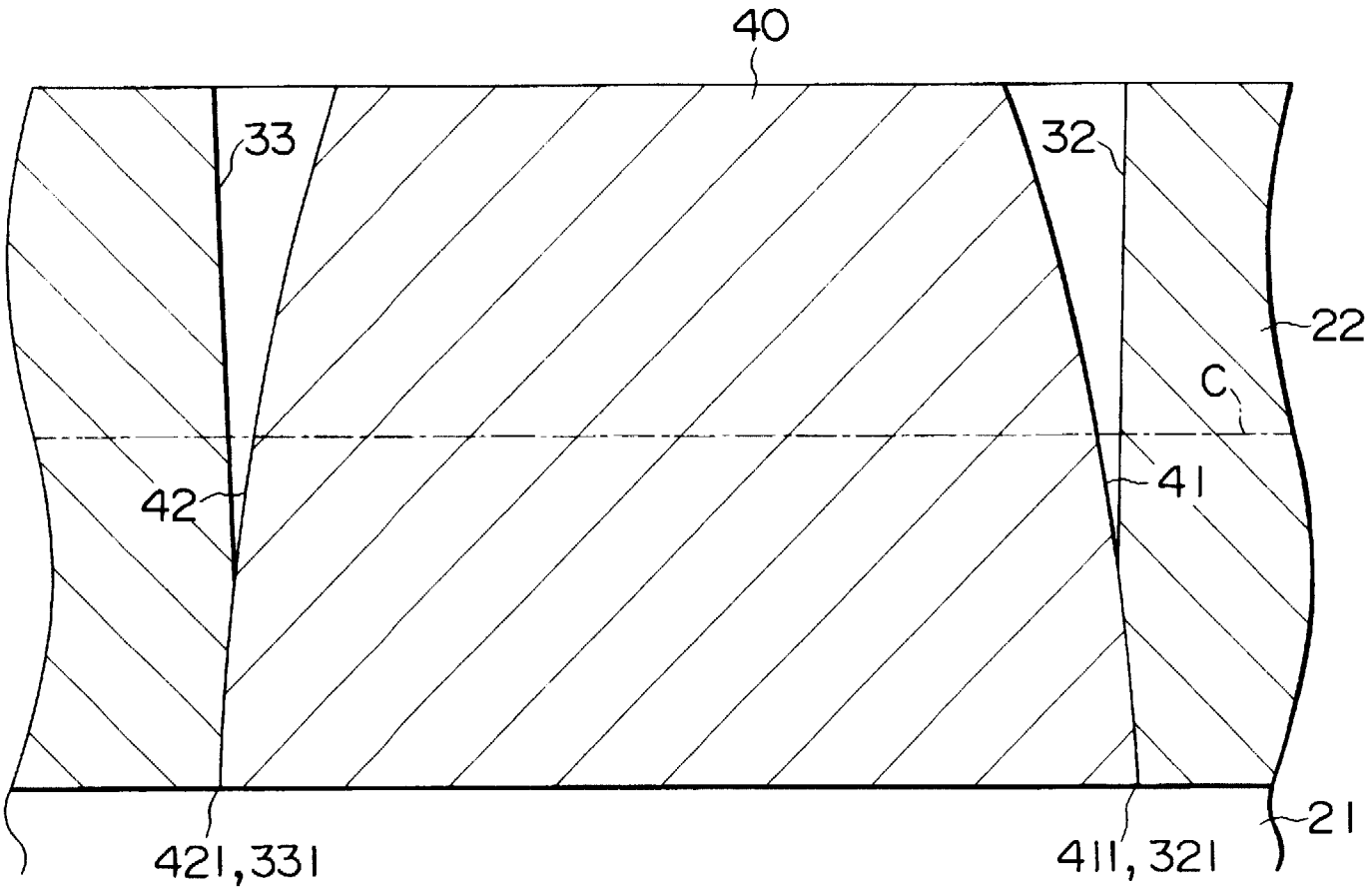
FIG. 14 is an enlarged vertical sectional view showing a major portion of the rapier band in a wrapping section.

In the drawings mentioned above, FIG. 13 shows the rapier band 22 according to the instant embodiment at the non-wrapping state, while FIG. 14 shows the same at the wrapping state. Parenthetically, it should be mentioned that in the practical applications, there arises no such situation in which teeth 40 penetrate into female holes 31 of the rapier band 22 at the non-wrapping state. The state illustrated in FIG. 13 is supposed only for the convenience of description. In the sprocket wheel according to the instant embodiment, the distance between base ends 411 and 421 of tooth surfaces 41 and 42, respectively, of each tooth 40 is so selected as to coincide or match with the distance between the wall surfaces 32 and 33 of the female hole 31 formed in the rapier band 22 in the non-wrapping state thereof. Accordingly, in the wrapping state of the rapier band 22 illustrated in FIG. 14, each base end portion 411, 421 of the tooth surfaces 41, 42 of the tooth 40 tends to intrude into the wall surfaces 32, 33 of the female hole 31 in the vicinity of the base end portions 321, 331 thereof. However, such tendency is negligibly insignificant. In the non-wrapping state of the rapier band 22, the base end portions 411 and 421 of the tooth surfaces 41 and 42, respectively, of the tooth 40 are simply brought into contact with the base end portions 321 and 331 of the wall surfaces 32 and 33, respectively, of the female hole 31 without being accompanied for any appreciable thrust or encroachment. Accordingly, in the transitional section D, as the tooth 40 moves away from the radial line 211 of the sprocket wheel 21, following the rotation of the sprocket wheel 21 in the clockwise direction, as viewed in FIG. 12, the tooth 40 can escape from the female hole 31 without abrading the wall surfaces 32, 33 of the female hole 31. In this manner, the wall surfaces 32, 33 of the female hole 31 can be protected against wear due to abrasion by the teeth 40, which of course means that the useful or service life of the rapier band 22 can be extended.

In the structure according to the fifth embodiment of the invention described above, the base end portions 321 and 331 of the wall surfaces 32 and 33 of the female hole 31 undergo elastic deformation or surface traction upon contacting the tooth surfaces 41 and 42 of the tooth 40. It goes however without saying that the base end portions 321 and 331 of the wall surfaces 32 and 33 can be so shaped that they can be brought into contact with the tooth surfaces 41 and 42 of the tooth 40 without being subjected to elastic deformation or surface traction. In that case, the wall surfaces 32 and 33 of the rapier band may be so formed that they contact the teeth of the sprocket wheel with at least portions of the wall surfaces located lower than the expansion/contraction-insusceptible layer C being protected against deformation in the wrapping section of the rapier band, while the remaining portions of the wall surfaces extend in parallel with each other in the non-wrapping section. The width of the parallel extending portion is shorter than the distance between the leading and trailing base end portions of the tooth of the sprocket wheel in the non-wrapping section.

Embodiment 6

Figure 15:
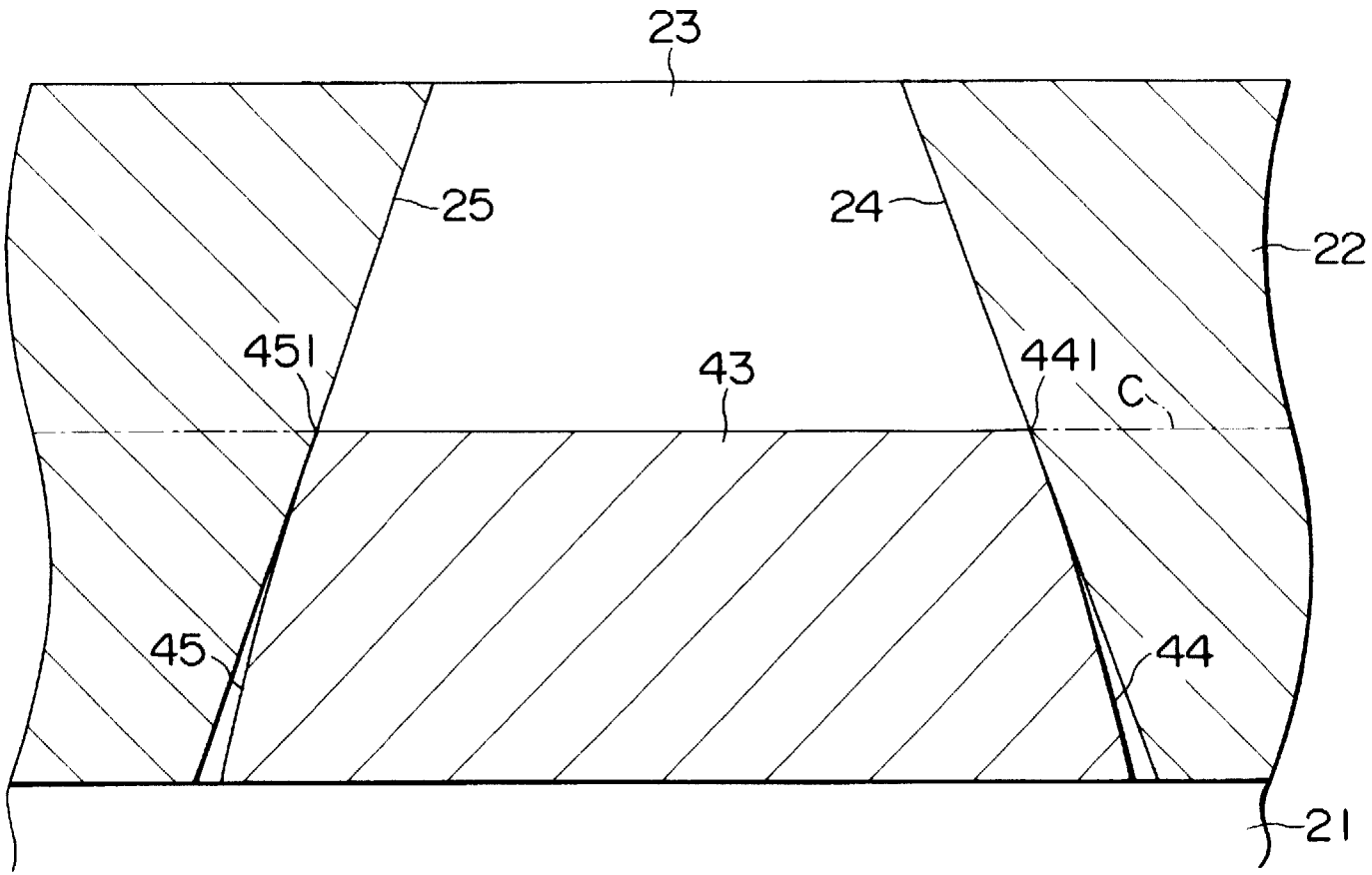
FIG. 15 is a side elevational view showing in a vertical section a rapier band and a sprocket wheel according to a sixth embodiment of the present invention.

Next, a sixth embodiment of the present invention will be described by reference to FIG. 15 in which parts the same as or equivalent to those of the first embodiment are denoted by like reference symbols.

The tooth 43 of the sprocket wheel 21 according to the instant embodiment of the invention is so designed that a portion of the tooth 26 of the sprocket wheel according to the firsts embodiment which is located above the expansion/contraction-insusceptible layer C is deleted or removed. With the structure of the sprocket wheel according to the instant embodiment, the wall surfaces 24, 25 of the female holes 23 can be protected against abrasion. Besides, machining for forming the teeth 26 can significantly be simplified and facilitated when compared with the machining of the teeth 26 of the sprocket wheel according to the first embodiment of the invention because only the machining for forming the interference-shape portions 44 and 45 of the tooth 43 has to be taken into consideration.

Parenthetically, it is possible to select the height of the tooth of the sprocket wheel 21 higher than that of the tooth of the sprocket wheel according to the sixth embodiment and lower than that of the tooth 26 of the sprocket wheel according to the first embodiment. In that case, the non-interference portion of the tooth wall will be smoothly brought into contact with the interference portion. In the case of the structure of the rapier band and the sprocket wheel according to the sixth embodiment of the invention, the top end portions 441 and 451 of the tooth surfaces 44 and 45 of the tooth 43 are brought into contact with the wall surfaces 24 and 25, respectively, of the female holes 23. However, in the modified structure in which the height of the tooth is greater than the expansion/contraction-insusceptible layer C, the tooth surface is forced to make surface contact with the wall surface of the female hole. Accordingly, a situation in which a depression appears in the wall surfaces of the female hole due to linear contact can be positively suppressed.

Embodiment 7

Figure 16:
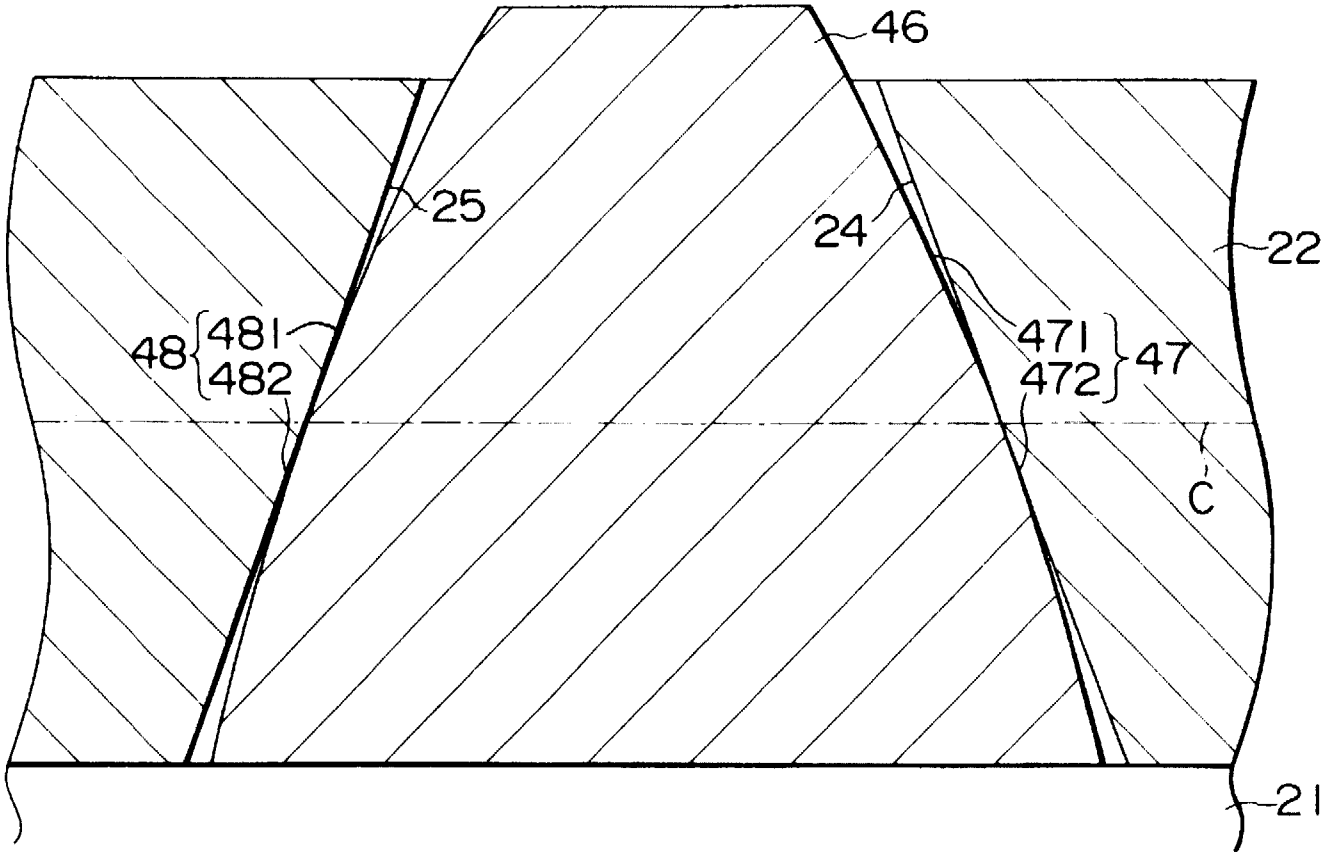
FIG. 16 is a side elevational view showing in a vertical section a rapier band and a sprocket wheel according to a seventh embodiment of the present invention.
Figure 17:
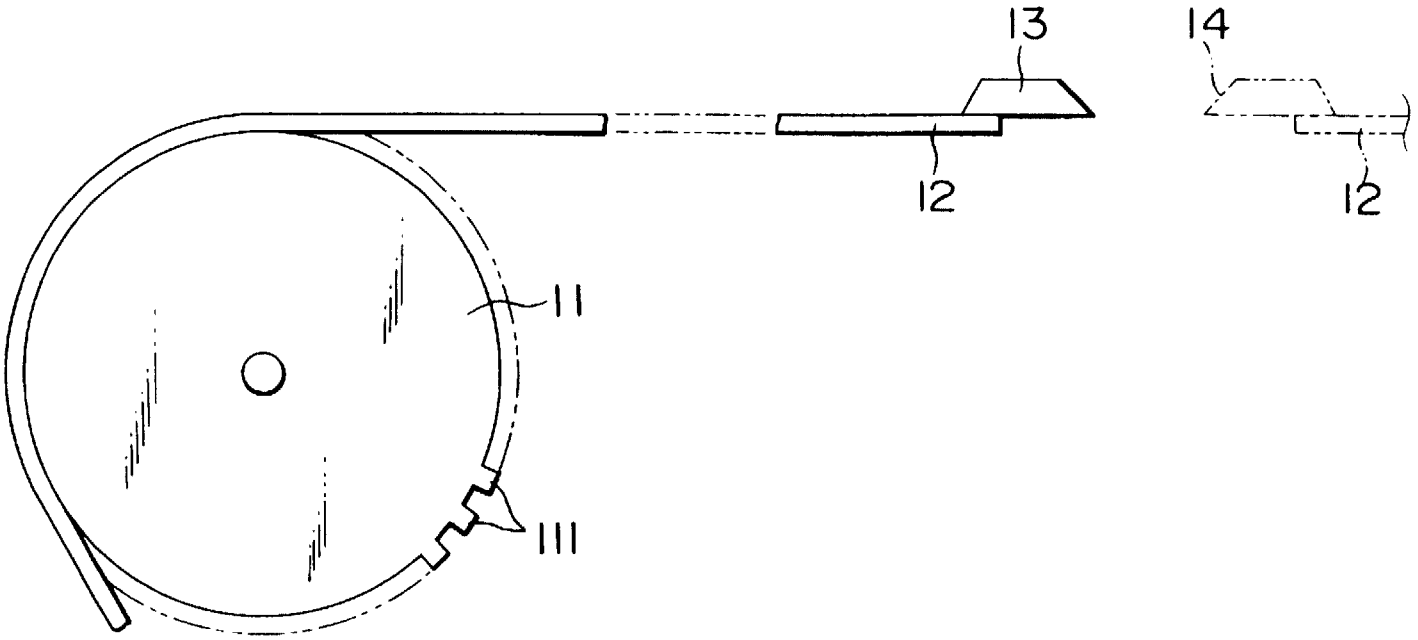
FIG. 17 PRIOR ART
FIG. 17 is a side elevational view of a rapier loom for illustrating only schematically a conventional weft inserting apparatus employed in a rapier loom.
Figure 18A:
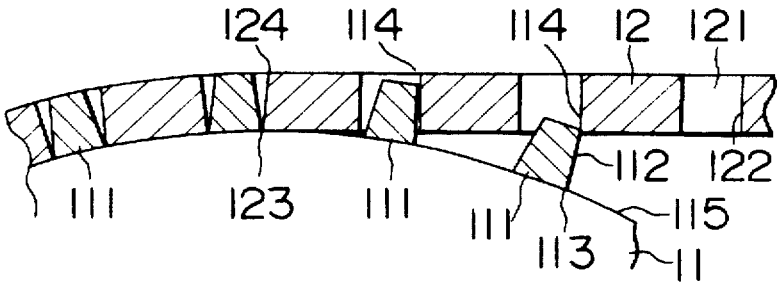
FIG. 18A PRIOR ART
FIG. 18A is a side elevational view showing in a vertical section major portions of a sprocket wheel and a rapier band of a conventional weft inserting apparatus known heretofore.
Figure 18B:
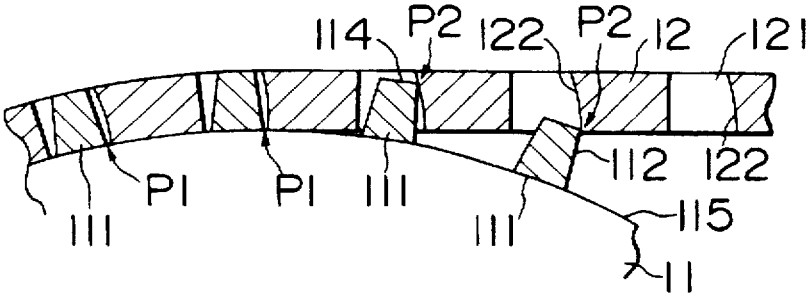
FIG. 18B PRIOR ART
FIG. 18B is a view similar to FIG. 18A and shows abrasion of wall surfaces of female holes formed in the rapier band in the conventional weft inserting apparatus.
Figure 18C:
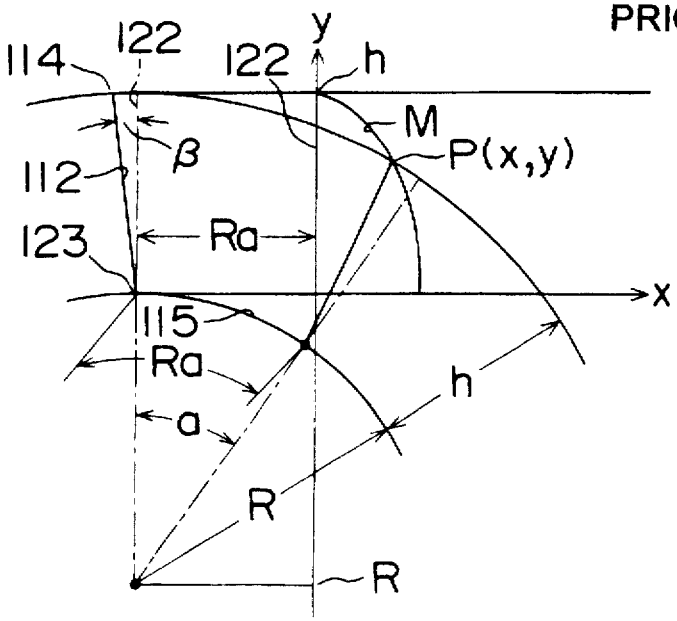
FIG. 18C PRIOR ART
FIG. 18C is a view for illustrating a mechanism of occurrence of abrasion in the wall surface of holes of the rapier band in the conventional weft inserting apparatus.

Finally, a seventh embodiment of the present invention will be described by reference to FIG. 16 in which parts the same as or equivalent to those of the first embodiment are denoted by like reference symbols.

According to the instant embodiment of the invention, each of the teeth 46 of the sprocket wheel 21 is designed to have a greater height than the tooth of the sprocket according to the first embodiment of the invention. The tooth 46 has tooth surfaces 47 and 48 formed with non-interference portions 471 and 481 which continue smoothly to interference portions 472 and 482, respectively. In the case of the sprocket wheel according to the first embodiment of the invention, the tooth 26 has a height which is substantially equal to the thickness of the rapier band 22. It should however be mentioned that in the case of the sprocket wheel according to the instant embodiment of the invention, the tooth projects upwardly from the female holes 23, because the projecting portion does not contact the wall surfaces 24 and 25 of the female holes 23 formed in the rapier band 22, thus involving no problem. Usually, the rapier band 22 is regulated with respect to the position thereof by guide means (not shown) so that the rapier band 22 does not slip off from the sprocket wheel 21. In this conjunction, the instant embodiment of the invention is advantageous in that even when the regulation of the position of the rapier band 22 as effected by the guide means is unsatisfactory, the rapier band 22 is less susceptible to slipping-off from the sprocket wheel 21.

Modifications

The foregoing description of the various embodiments of the invention has been made on the presumption that the rapier band is withdrawn in the tangential direction from the wrapping section around the sprocket wheel. In practical applications, however, the form or state which the rapier band assumes upon being withdrawn (i.e., the shape of the rapier band at the non-wrapping section) is curvilinear, although it depends on the type of the guide means mentioned above. However, deviation of such curved form from the tangential line mentioned above is negligibly insignificant. Needless to say, the present invention can be equally applied to a rapier loom in which the deviation mentioned above is likely to occur.

Furthermore, the invention may be carried out in the modes mentioned below without departing from the spirit and scope of the invention.

(1) The height of the teeth of the sprocket wheel may be designed to be lower than that of the holes formed in the rapier band and higher than the level of the expansion/contraction-insusceptible layer C. Machining for forming the teeth of the sprocket wheel will thereby be facilitated.

(2) The teeth of the sprocket wheel may imparted with a height greater than the thickness of the rapier band. The rapier band can be thereby held in the meshing state with the sprocket wheel more positively.

(3) The sprocket wheel may be so designed that the center of curvature of the base circle thereof coincides with the center of curvature of the dedendum circle (root circle). In that case, the tooth surface of the sprocket wheel can be imparted with desired shape more easily.

With the embodiments of the invention described above, there can be ensured the following advantageous effects.

(1) With the structure of the sprocket wheel having a curved surface at the non-interference portion which is generated with an involute curve, as described hereinbefore, the wall surface of the female hole formed in the rapier band can be positively protected against wear due to abrasion by the teeth of the sprocket wheel.

(2) By offsetting the curved surface of the non-interference portion inwardly relative to the curved surface generated by translating an involute curve while offsetting the curved surface of the interference portion inwardly relative to a modified wall surface of the female hole formed in the rapier band in the wrapping section, the wall surface of the female hole can be positively protected against wear due to abrasion by the teeth of the sprocket wheel.

(3) With the structure of the sprocket wheel in which the interference portion of the tooth surface of the sprocket wheel is implemented in the form of an oblique or slanted plane, machining for forming the tooth surfaces as well as the teeth of the sprocket wheel can be facilitated.

(4) By designing the sprocket wheel so that the height of the teeth thereof is higher than the expansion/contraction-insusceptible layer C of the rapier band and smaller than the thickness of the rapier band so that the non-interference portion continues smoothly to the interference portion, such unwanted phenomenon as appearance of concaves or depressions in the wall surfaces of the female holes of the rapier band can be avoided with high reliability.

As will now be understood from the foregoing description, the weft inserting apparatus for the rapier loom in which the sprocket wheel and the rapier band implemented according to the teachings of the invention are employed can enjoy very profitable and advantageous effects in that the service life of the rapier band can be significantly extended because wear or abrasion of the female holes formed in the rapier band can effectively suppressed.

Many modifications and variations of the present invention are possible in the light of the above techniques. It is therefore to be understood that within the scope of the appended claims, the invention may be practiced otherwise than as specifically described.

What is claimed is:

1. An apparatus for use in a rapier loom said apparatus including a sprocket wheel having a plurality of teeth formed along an outer periphery thereof and mounted for reciprocating rotational motion, and a rapier band having a rapier head mounted at a tip end thereof and a plurality of holes formed therethrough so as to extend between an inner surface of said rapier band facing toward said sprocket wheel and an outer surface thereof remote from said sprocket wheel, said rapier band being partially wrapped around said sprocket wheel with said teeth thereof meshing with said holes of said rapier band so that said rapier band is caused to reciprocatingly travel, thereby alternately inserting and withdrawing said rapier head into and from a shedding formed by warps under the reciprocating motion of said sprocket wheel, said sprocket wheel being characterized in that:

each said tooth of said sprocket wheel has tooth surfaces located upstream and downstream with respect to the rotating directions of said sprocket wheel, each said tooth surface including a dedendum surface portion and an addendum surface portion which differ in shape such that in a band meshing region in which said rapier band wraps around said sprocket wheel, each said dedendum surface portion is brought into contact with an oppositely facing wall surface of the corresponding hole of said rapier band, while in a transitional region intervening between said meshing region and a band releasing region in which said rapier band gets free from interference of said teeth of said sprocket wheel, each said dedendum surface portion does not contact said wall surface of said corresponding hole of said rapier band; and each said addendum surface portion has such shape that in said transitional region, said addendum surface portion does not contact said wall surface of said corresponding hole of said rapier band.

2. An apparatus according to claim 1, wherein a boundary between said dedendum surface portion and said addendum surface portion of each said tooth surface is positioned on a plane corresponding to an expansion/contraction-insusceptible layer of said rapier band which undergoes neither expansion nor contraction in a peripheral direction of said sprocket wheel when said rapier band is wrapped around said sprocket wheel.

3. An apparatus according to claim 2, wherein said dedendum surface portion of said tooth surface has a shape which substantially matches a shape of a wall portion of said corresponding hole, which wall portion is located underneath said plane corresponding to said expansion/contraction-insusceptible layer of said rapier band and undergoes deformation under pressure applied thereto when said rapier band is wrapped around said sprocket wheel.

4. The apparatus according to claim 2, wherein a major part of said dedendum surface portion of said tooth surface is formed on an oblique plane which approximates a shape of a wall portion of said corresponding hole, which wall portion is located underneath said plane corresponding to said expansion/contraction-insusceptible layer of said rapier band and undergoes deformation under pressure applied thereto when said rapier band is wrapped around said sprocket wheel.

5. The apparatus according to claim 2, wherein said addendum surface portion of each of the tooth surfaces of said tooth has an involutely curved surface so that a pressure angle on a boundary between said dedendum surface portion and said addendum surface portion has a value equal to or greater than a value of an angle formed between said wall surface of said hole of said rapier band and a center axis of said hole when said rapier band is in a state not wrapped around said sprocket wheel.

6. The apparatus according to claim 2, wherein said dedendum surface portions of said tooth surfaces of said tooth of said sprocket wheel have respective base end portions lying on said involutely curved surfaces, respectively, while the surface portions of said dedendum surface portions other than said base end portions have respective involutely curved surfaces located inwardly relative to the first said involutely curved surfaces.

7. The apparatus according to claim 1, wherein said dedendum surface portion of each said tooth surface has a shape which substantially matches a shape of a wall portion of said hole, which wall portion is located underneath said plane corresponding to said expansion/contraction-insusceptible layer of said rapier band and undergoes deformation under pressure applied thereto when said rapier band is wrapped around said sprocket wheel.

8. The apparatus according to claim 1, wherein a major part of said dedendum surface portion of each said tooth surface is formed on an oblique plane which approximates a shape of a wall portion of said hole, which wall portion is located underneath said plane corresponding to said expansion/contraction-insusceptible layer of said rapier band and undergoes deformation under pressure applied thereto when said rapier band is wrapped around said sprocket wheel.

9. The apparatus according to claim 1, wherein said addendum surface portion of each of the tooth surfaces of said tooth has an involutely curved surface so that a pressure angle on a boundary between said dedendum surface portion and said addendum surface portion has a value equal to or greater than a value of an angle formed between said wall surface of said hole of said rapier and and a center axis of said hole when said rapier band is in a state not wrapped around said sprocket wheel.

10. The apparatus according to claim 9, wherein each of said holes of said rapier band is formed as a vertical hole, each said tooth of said sprocket wheel having respective surfaces each including a base end portion, and a distance between said base end portions of said respective surfaces of each tooth of said sprocket wheel is not smaller than a distance between the wall surfaces of each hole of said rapier band in the state where said rapier band is wrapped around said sprocket wheel.

11. The apparatus according to claim 9, wherein each said dedendum surface portion of said tooth of said sprocket wheel has a bottom end portion, and portions of said wall surfaces of each said hole formed in said rapier band and located beneath the plane corresponding to said expansion/contraction-insusceptible layer are formed in a flaring configuration so that said bottom end portions of said dedendum surface portions of said tooth of said sprocket wheel are brought into contact with portions of said wall surfaces of the hole of said rapier band when said rapier band is in the state wrapped around said sprocket wheel.

12. The apparatus according to claim 9, wherein a base circle for said involutely curved surface has a radius which is shorter than a radius of the dedendum circle of the teeth of said sprocket wheel.

13. The apparatus according to claim 12, wherein each of said holes of said rapier band is formed as a vertical hole, each said tooth of said sprocket wheel having respective surfaces each including a base end portion, and a distance between said base end portions of respective surfaces of each tooth of said sprocket wheel is not smaller than a distance between the wall surfaces of each hole of said rapier band in the state where said rapier band is wrapped around said sprocket wheel.

14. The apparatus according to claim 12, wherein each said dedendum surface portion of said tooth of said sprocket wheel has a bottom end portion, and portions of said wall surfaces of each said hole formed in said rapier band and located beneath the plane corresponding to said expansion/contraction-insusceptible layer are formed in a flaring configuration so that said bottom end portions of said dedendum surface portions of said tooth of said sprocket wheel are brought into contact with portions of said wall surfaces of the hole of said rapier band when said rapier band is in the state wrapped around said sprocket wheel.

15. The apparatus according to claim 9, wherein a base circle for said involutely curved surface has a radius which is equal to a radius of the dedendum circle of the teeth of said sprocket wheel.

16. The apparatus according to claim 15, wherein each of said holes of said rapier band is formed as a vertical hole, each said tooth of said sprocket wheel having respective surfaces each including a base end portion, and a distance between said base end portions of respective surfaces of each tooth of said sprocket wheel is not smaller than a distance between the wall surfaces of each hole of said rapier band in the state where said rapier band is wrapped around said sprocket wheel.

17. The apparatus according to claim 15, wherein each said dedendum surface portion of said tooth of said sprocket wheel has a bottom end portion, and portions of said wall surfaces of each said hole formed in said rapier band and located beneath the plane corresponding to said expansion/contraction-insusceptible layer are formed in a flaring configuration so that said bottom end portions of said dedendum surface portions of said tooth of said sprocket wheel are brought into contact with portions of said wall surfaces of the hole of said rapier band when said rapier band is in the state wrapped around said sprocket wheel.

18. The apparatus according to claim 1, wherein said dedendum surface portions of said tooth surfaces of said tooth of said sprocket wheel have respective base end portions lying on said involutely curved surfaces, respectively, while the surface portions of said dedendum surface portions other than said base end portions have respective involutely curved surfaces located inwardly relative to the first said involutely curved surfaces.

19. The apparatus according to claim 18, wherein each of said holes of said rapier band is formed as a vertical hole, each said tooth of said sprocket wheel having respective surfaces each including a base end portion, and a distance between said base end portions of respective surfaces of each tooth of said sprocket wheel is not smaller than a distance between the wall surfaces of each hole of said rapier band in the state where said rapier band is wrapped around said sprocket wheel.

20. The apparatus according to claim 18, wherein each said dedendum surface portion of said tooth of said sprocket wheel has a bottom end portion, and portions of said wall surfaces of each said hole formed in said rapier band and located beneath the plane corresponding to said expansion/contraction-insusceptible layer are formed in a flaring configuration so that said bottom end portions of said dedendum surface portions of said tooth of said sprocket wheel are brought into contact with portions of said wall surfaces of the hole of said rapier band when said rapier band is in the state wrapped around said sprocket wheel.

21. A rapier loom comprising a sprocket wheel having a plurality of teeth formed along an outer periphery thereof and mounted for reciprocating rotational motion, and a rapier band having a rapier head mounted at a tip end thereof and a plurality of holes formed therethrough so as to extend between an inner surface of said rapier band facing toward said sprocket wheel, said rapier band being partially wrapped around said sprocket wheel with said teeth meshing with said holes of said rapier band so that said rapier band is caused to travel reciprocatingly, thereby alternately inserting and withdrawing said rapier head into and from a shedding formed by warps under the reciprocating rotation of said sprocket wheel, said rapier loom being characterized in that:

each said tooth of said sprocket wheel has tooth surfaces located upstream and downstream with respect to the rotating directions of said sprocket wheel, each said tooth surface having a dedendum surface portion and an addendum surface portion which differ in shape such that in a band meshing region in which said rapier band wraps around said sprocket wheel, each said dedendum surface portion is brought into contact with an oppositely facing wall surface of the corresponding hole of said rapier band, while in a transitional region intervening between said meshing region and a band releasing region in which said rapier band gets free from interference of said teeth of said sprocket wheel, each said dedendum surface portion does not contact said wall surface of said corresponding hole of said rapier band, and each said addendum surface portion has such shape that in said transitional region, said addendum surface portion does not contact said wall surface of said corresponding hole of said rapier band; and said wall surfaces of said holes located upstream and downstream with respect to a traveling direction of said rapier band are each formed on an oblique plane so that portions of said wall surfaces located closer to said outer surface of said rapier band are closer to each other as viewed in a direction thicknessswise of said rapier band orthogonally to said traveling direction thereof when said rapier band is in a state not wrapped around said sprocket wheel.

* * * * *

UNITED STATES PATENT AND TRADEMARK OFFICE

CERTIFICATE OF CORRECTION

PATENT NO. : 5,785,095
DATED : July 28, 1998
INVENTOR(S) : Kinbara

It is certified that error appears in the above-identified patent and that said Letters Patent is hereby corrected as shown below:

Column 2, line 55, change " reciprocatingly" to --reciprocating--.

Column 7, line 60, after " by" delete the comma " ," ;

line 61, change " x-y" to - -x,y- -.

Column 12, line 15, change " for" to - -by- -.

Column 14, line 50, after " can" insert - -be- -;

line 58, after " loom" , insert a comma " ," .

Column 15, line 26, change " An" to - -The- -.

Signed and Sealed this

Second Day of March, 1999

*Attest:*

*Attesting Officer*

Q. TODD DICKINSON

*Acting Commissioner of Patents and Trademarks*